US006060202A

United States Patent [19]

Ogawa et al.

[11] Patent Number: 6,060,202

[45] Date of Patent: May 9, 2000

[54] TONER FOR DEVELOPING ELECTROSTATIC IMAGES IMAGE FORMING METHOD AND PROCESS CARTRIDGE

[75] Inventors: Yoshihiro Ogawa; Koichi Tomiyama, both of Numazu; Keita Nozawa, Shizuoka-ken; Shunji Suzuki, Tokyo, all of Japan

[73] Assignee: Canon Kabushiki Kaisha, Tokyo, Japan

[21] Appl. No.: 09/046,435

[22] Filed: Mar. 24, 1998

[30] Foreign Application Priority Data

Mar. 26, 1997 [JP] Japan ..... 9-072861
Jul. 11, 1997 [JP] Japan ..... 9-305145

[51] Int. Cl.[7] ..... G03G 13/08

[52] U.S. Cl. ..... 430/111; 430/120; 399/225

[58] Field of Search ..... 430/106, 110, 430/111, 120; 399/225

[56] References Cited

U.S. PATENT DOCUMENTS

| | | | |
|---|---|---|---|
| 5,137,796 | 8/1992 | Takiguchi et al. | 430/106.6 |
| 5,679,491 | 10/1997 | Oshiba et al. | 430/111 |
| 5,750,302 | 5/1998 | Ogawa et al. | 430/106.6 |
| 5,825,477 | 10/1998 | Furuie | 356/72 |

FOREIGN PATENT DOCUMENTS

| | | |
|---|---|---|
| 0701177 | 3/1996 | European Pat. Off. . |
| 0 727717 | 8/1996 | European Pat. Off. . |
| 0 762223 | 3/1997 | European Pat. Off. . |
| 42-27596 | 12/1967 | Japan . |
| 44-6397 | 3/1969 | Japan . |
| 45-26478 | 9/1970 | Japan . |
| 50-133338 | 10/1975 | Japan . |
| 1-112253 | 4/1989 | Japan . |
| 2-284158 | 11/1990 | Japan . |
| 6-67458 | 3/1994 | Japan . |
| 6-3854 | 1/1995 | Japan . |
| 8-136439 | 5/1996 | Japan . |
| 8-278659 | 10/1996 | Japan . |
| 41-20153 | 11/1996 | Japan . |

*Primary Examiner*—John Goodrow
*Attorney, Agent, or Firm*—Fitzpatrick, Cella, Harper & Scinto

[57] ABSTRACT

An electrophotographic toner including a blend of toner particles, and external additive particles, is provided with characteristic particle size distribution conditions, i.e., (i) a particle size distribution based on a Coulter counter measurement, including a weight-average particle size D4 of X $\mu$m and Y % by number of particles having sizes of 2.00–3.17 $\mu$m satisfying:

$$-5X+35 \leqq Y \leqq -25X+180 \quad (1)$$

$$3.5 \leqq X \leqq 6.5 \quad (2), \text{ and}$$

(ii) a particle size distribution based on a flow particle image analyzer measurement, including A % by number of particles having circle-equivalent diameters of at least 1.00 $\mu$m and below 1.03 $\mu$m and B % by number of particles having circle-equivalent diameters of at least 2.00 $\mu$m and below 2.06 $\mu$m satisfying:

$$B-A \leqq 0.30 \quad (3).$$

As a result, the toner is provided with a stable developing performance even in a long period of continuous image formation in a high temperature/high humidity environment.

108 Claims, 4 Drawing Sheets

TONER FOR DEVELOPING ELECTROSTATIC IMAGES IMAGE FORMING METHOD AND PROCESS CARTRIDGE

FIELD OF THE INVENTION AND RELATED ART

The present invention relates to a toner for developing electrostatic images formed in, e.g., electrophotography or electrostatic printing, and an image forming method and a process cartridge using the toner.

Hitherto, there have been known many methods for electrophotography, wherein generally an electrostatic (latent) image is formed on a photosensitive member according to various means by utilizing a photoconductive substance, the electrostatic image is developed with a toner to form a visible image (toner image), and the toner image is, after being transferred to a transfer-receiving material, such as paper, fixed onto the transfer-receiving material under application of heat and/or pressure, to form a fixed image.

In recent years, an image forming apparatus utilizing the electrophotography has been applied to various apparatus including, e.g., a printer and a facsimile apparatus, in addition to copying apparatus conventionally used heretofore. For example, the printer utilizing the electrophotography includes an LED printer and an LBP printer which principally comply with the demand on the market and for which higher resolutions of 400, 600 and 1200 dpi are being required compared with conventional levels of 240–300 dpi. Accordingly, the developing scheme therefor is also required to show a higher resolution. Also in the copying apparatus, higher performances are required, and a principal demand is directed to a digital image forming technique as a trend. The digital image formation principally involves the use of a laser for forming electrostatic images for which a higher resolution is intended. Thus, similarly as in the printer, a developing scheme of a higher resolution and a higher definition is demanded. For complying with such demands, Japanese Laid-Open Patent Application (JP-A) 1-112253 and JP-A 2-284158 have proposed toners of smaller particle sizes.

However, in view of the copying apparatus and printer developed in recent years and having a higher speed and a longer life, the durability of a toner is not necessarily sufficient, and a toner is liable to cause problems due to toner deterioration, such as lowering in image density and resolution, when continually used for a long period, e.g., in a high temperature/high humidity environment.

JP-A 8-278659 (corr. to EP-A 0727717) has disclosed a toner for developing electrostatic images, having a specific weight-average particle size and containing a specific proportion of particles having particle sizes of at most 3.17 μm. The JP reference discloses a toner capable of providing high-quality images but has paid no particular attention to particles having sizes of below 2 μm, thus leaving a room for improvement in continuous image forming performance on a large number of sheets particularly in a high temperature/high humidity environment.

JP-A 6-67458 (corr. to U.S. Pat. No. 5,406,357) discloses a developer for developing electrostatic images, comprising: a magnetic toner comprising a binder resin component having a specific molecular weight distribution, and specific proportions of additives including silica fine powder, metal oxide fine powder and fluorine-containing resin powder, so as to exhibit suppressed toner melt-sticking onto a contact charging member, and a contact transfer member and also excellent low-temperature fixability and anti-offset characteristic.

EP-A 0762223 discloses a toner for developing electrostatic images comprising particles containing a specific complex oxide so as to exhibit improved developing stability and continuous image forming performance.

JP-A 6-3854 discloses a developer comprising a magnetic toner, a flowability improving agent and a metal oxide fine powder having a specific particle size distribution, designed for a specific image forming apparatus.

The above proposals, however, have not paid due attention to a content of toner particles having sizes of below 2.0 μm in case of providing a toner having a smaller weight-average particle size so as to provide high-quality images having excellent dot reproducibility, thus leaving a room for improvement for continuously forming high-quality images on a large number of sheets, particularly in a high temperature/high humidity environment.

Thus, the toner performances have been insufficient and have left a room for improvement in many respects.

SUMMARY OF THE INVENTION

A generic object of the present invention is to provide a toner for developing electrostatic images, having solved the above-mentioned problems.

A more specific object of the present invention is to provide a toner for developing electrostatic images, capable of providing high-resolution and high-definition images having a high image density and with little fog (i.e., toner attachment at non-image portions) for a long period in various environments including a high temperature/high humidity environment and a low temperature/low humidity environment.

Another object of the present invention is to provide an image forming method, and a process cartridge using the toner.

According to the present invention, there is provided a toner for developing electrostatic images, comprising: toner particles comprising a binder resin and a colorant, and external additive particles;

wherein the toner satisfies the particle size distribution conditions (i) and (ii) below, (i) a particle size distribution based on volume-basis and number-basis particle size distribution of particles having sizes in a range of 2.00–40.30 μm as measured by a Coulter counter, including a weight-average particle size D4 of X μm and Y % by number of particles having sizes of 2.00–3.17 μm satisfying the following conditions (1) and (2):

$$-5X+35 \leqq Y \leqq -25X+180 \quad (1)$$

$$3.5 \leqq X \leqq 6.5 \quad (2), \text{ and}$$

(ii) a particle size distribution of particles having circle-equivalent diameters in a range of 0.60 μm–159.21 μm (upper limit, not inclusive) as measured by a flow particle image analyzer, including A % by number of particles having circle-equivalent diameters of at least 1.00 μm and below 1.03 μm and B % by number of particles having circle-equivalent diameters of at least 2.00 μm and below 2.06 μm satisfying the following condition (3):

$$B-A \leqq 0.30 \quad (3).$$

According to another aspect of the present invention, there is provided an image forming method, comprising the steps of:

charging an image-bearing member for bearing an electrostatic latent image thereon;

forming an electrostatic latent image on the charged image bearing member, and developing the electrostatic latent image on the image-bearing member with the above-mentioned toner of the present invention to form a toner image.

According to another aspect of the present invention, there is provided a process cartridge detachably mountable to a main body of an image forming apparatus, comprising:

an image-bearing member for bearing an electrostatic latent image, and a developing means containing the above-mentioned toner of the present invention for developing an electrostatic latent image on the image-bearing member to form a toner image.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1A:
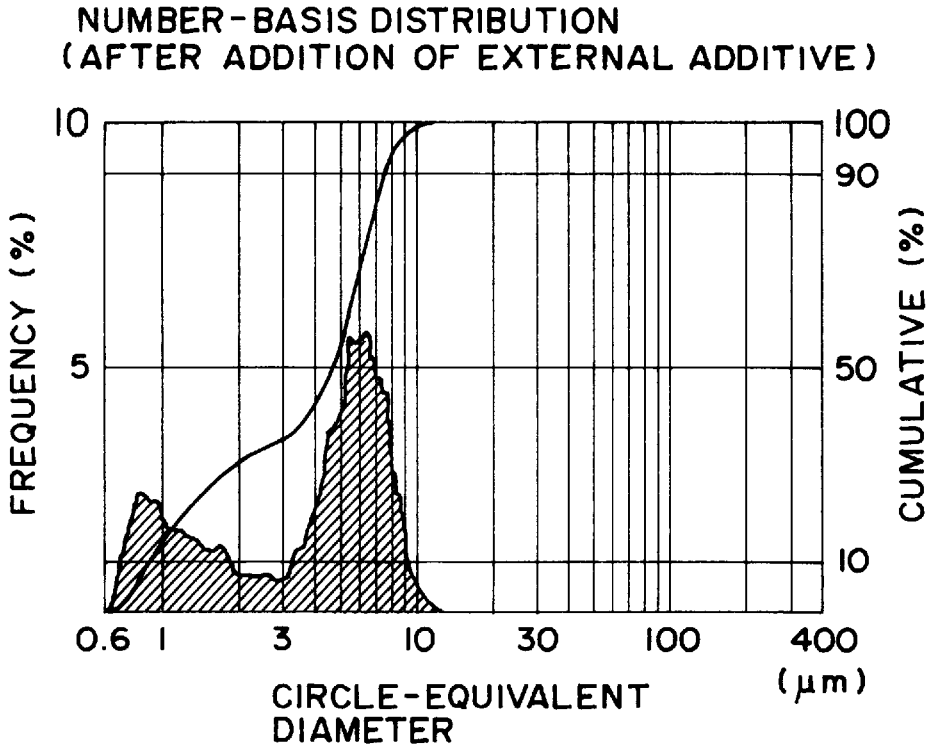
FIGS. 1A and 1B are graphs showing number-basis distributions of circle-equivalent diameters of particles as measured by a flow particle image analyzer of a toner prepared in Example 12 described hereinafter, after addition and before addition, respectively, of external additive.

A characteristic feature of the toner for developing electrostatic images according to the present invention is that it has a particle size distribution in a range of 2.00–40.30 μm as measured by a Coulter counter including a weight-average particle size (diameter) (D4) of X μm and Y % by number of particles having sizes of 2.00–3.17 μm satisfying: $-5X+35 \leqq Y \leqq -25X+180$ (preferably $-5X+35 \leqq Y \leqq -12.5X+98.75$), and $3.5 \leqq X \leqq 6.5$ (preferably $4.0 \leqq X \leqq 6.3$). A toner having such a particle size distribution can provide high-resolution and high-definition images which have a high image density, are free from fog and are excellent in dot reproducibility.

A toner having a weight-average particle size (D4) of below 3.5 μm ($X<3.5$) is liable to cause a charge-up phenomenon (i.e., liable to be excessively charged), thus resulting in a lower image density. A toner of $X>6.5$ (μm) is not preferred because of inferior dot reproducibility. A toner containing particles of 2.00–3.17 μm at Y (% by number) smaller than $-5X+35$ results in an inferior dot reproducibility similarly as in the case of X (μm)>6.5 (μm). A toner of Y (% by number)>$-25X+180$ is liable to result in increased fog.

In other words, the present invention provides a toner which has a reduced weight-average particle size (D4) suitable for forming a higher-resolution and higher-definition image while controlling the content of particles of 2.00–3.17 at an optimum level with respect to the weight-average particle size (D4) of the toner.

As a result of further study of ours, it has been found that a toner satisfying the above-mentioned particle size distribution can still cause a lowering in toner flowability and chargeability, thus image quality deterioration and image density lowering, when subjected to a long period of continuous image formation in a high temperature/high humidity environment.

As a result of further study and investigation of the phenomenon, there has been confirmed an influence of fine particles having sizes of below 2.00 μm not measurable by a conventionally used Coulter counter (i.e. Model "TA-II" or "Coulter Multisizer"), and the size and distribution of such fine particles can be analyzed by using a flow particle image analyzer. Such fine particles of below 2.00 μm include fine toner particles and fine external additive particles.

More specifically, in order to provide a toner free from a lowering in toner chargeability, a lowering in image density or a deterioration of image quality and capable of providing images with excellent dot reproducibility even in a long period of continuous image formation in a high temperature/high humidity environment, it is important to satisfy a particle size distribution of particles in a range of 0.60 μm–159.21 μm as measured by a flow particle image analyzer, including A % by number of particles having circle-equivalent diameters of at least 1.00 μm and below 1.03 μm and B % by number of particles having circle-equivalent diameters of at least 200 μm and below 2.06 μm satisfying $B-A \leqq 0.30$, preferably $-0.63 \leqq B-A \leqq 0.30$, in addition to the above-mentioned particle size distribution based on the measurement by a Coulter counter.

The toner according to the present invention may preferably contain C % by number of particles of at least 1.00 μm and below 2.00 μm, satisfying $C>10$, more preferably $10 \leqq C \leqq 37.7$, according to the flow particle image analyzer measurement.

The mechanism by which the control of the content of fine particles analyzable by a flow particle image analyzer provides the above-mentioned effect has not been clarified as yet but may be assumed as follows. When a continuous image formation is performed for a long period in a high temperature/high humidity environment, external additive particles such as silica fine particles present on toner particle surfaces are liable to be embedded at the toner particle surfaces or the projecting parts of the toner particles are lost to result in a change in toner particle surface state, thus being liable to cause a lowering in flowability or a lowering in chargeability. In such a case, however, if fine particles having a prescribed size are controlled to be present in a specific proportion, a load applied onto the toner at the time of contact with a toner-charging member such as developing sleeve or a regulating blade, may be reduced to prevent the embedding of the external additive particles at the toner particle surfaces or the loss of toner particle projections.

Particularly, it is assumed that the effect of preventing the deterioration of particles in a particle size range of 2.00–31.7 μm having a high charge and a large influence on image quality such as dot reproducibility, is remarkably exhibited.

More specifically, in order to provide high-resolution and high-definition images excellent in dot reproducibility, it is important to use a toner having a small weight-average particle size and containing a specific proportion of particles of 2.00–3.17 μm depending on the weight-average particle size of the toner. Such particles of 2.00–3.17 μm have a large specific surface area per unit weight and therefore a large triboelectric charge per unit weight (μC/g), thus exhibiting a high electrostatic adsorption force onto a toner-carrying member, such as a particulate carrier or a developing sleeve, and being liable to receive a strong load. Accordingly, such particles of 2.00–3.17 μm are liable to cause the loss of toner particle projections and the embedding of the external additive particles, and moreover have a large specific surface area per unit weight than the larger toner particles as mentioned above, to which ultra fine particles having a primary average particle size of at most 20 mμ are liable to be attached at a larger amount per unit weight of the toner, so that such particles of 2.00–3.17 μm are liable to be affected by the external additive particles.

Presumably for the above reason, if a toner satisfying the above-mentioned particle size distribution condition based on the Coulter counter measurement also satisfies the above-mentioned specific particle size distribution condition based on the flow particle image analyzer measurement, the load of external additive particles acting onto the toner particles can be alleviated, thereby allowing the toner to maintain its performances of providing high-resolution and high-definition images having a high image density, free from fog and excellent in dot reproducibility over a long period in a severe environment like a high temperature/high humidity environment.

In case of B-A>0.30, the toner particles satisfying the particle size distribution condition based on the Coulter counter measurement cannot exhibit sufficient effect, and are liable to cause a lowering in image density and an image quality deterioration in a long term of continuous image formation.

In the case of B-A<−0.63, as the amount of particles having small circle-equivalent diameters is increased, the toner is liable to cause a charge-up phenomenon (i.e., be excessively charged), thus resulting in a lower image density.

In case where the toner contains less than 10% by number of particles having circle-equivalent diameters of at least 1.00 μm and below 2.0 μm, it becomes difficult to alleviate the load of fine external additive particles acting on the toner particles.

In order to satisfy the particle size distribution condition base on the flow particle image analyzer measurement, it is most convenient and preferred to blend under stirring toner particles with external additive particles (A) having a number-average circle-equivalent diameter based on the flow particle image analyzer measurement of 0.60–4.00 μm by means of a blender, such as a Henschel mixer.

Such external additive particles (A) having an average circle-equivalent diameter of 0.60–4.00 μm, preferably 1.00–400 μm, more preferably 1.0014 3.00 μm, have a particle size closer to that of toner particles of 2.00–3.17 μm and can behave similarly as the toner particles in the developing device. As a result, during a long period of image formation, it is assumed that the load applied to the toner particles of 2.00–3.17 μm is distributed to the external additive particles (A), thus suppressing the toner deterioration.

The external additive particles (A) having a number-average circle-equivalent diameter of 0.60–4.00 μm usable in the present invention may preferably contain a % by number of particles having circle-equivalent diameters of at least 1.00 μm and below 1.03 μm and b % by number of particles having circle-equivalent diameters of at least 2.00 μm and below 2.06 μm satisfying the condition of:

$$b-a \leqq 0.30,$$

more preferably $-0.63 \leqq b-a \leqq 0.30$, further preferably $$-0.51 \leqq b-a \leqq 0.30.$$

In case of b−a>0.30, the external additive particles (A) are caused to contain a large proportion of relatively large particles, so that the external additive particles (A) are liable to behave differently from the toner particles of 2.00–3.17 μm, thus showing a smaller effect of preventing toner deterioration.

In the case of b−a<0.63, the toner is liable to contain much particles having a small diameter, thus being liable to cause the charge-up phenomenon.

The external additive particles (A) having a number-average circle-equivalent diameter of 0.5–4.0 μm to be blended with toner particles may comprise an inorganic material or an organic material. More specifically, examples of the material constituting the external additive particles (A) may include: metal oxides, such as magnesium oxide, zinc oxide, aluminum oxide, cerium oxide, cobalt oxide, iron oxide, zirconium oxide, chromium oxide, manganese oxide, strontium oxide, tin oxide and antimony oxide; complex metal oxides, such as calcium titanate, magnesium titanate and strontium titanate; metal salts, such as calcium carbonate, magnesium carbonate, aluminum carbonate, barium sulfate, calcium sulfate, aluminum sulfate, and magnesium sulfate; clay minerals, such as kaolin; phosphate compounds, such as apatite; silicon compounds, such as silica, silicon carbide and silicon nitride; carbon compounds, such as carbon black and graphite; resins such as epoxy resin, phenolic resin, polyamide resin, silicone resin, silicone rubber, urethane resin, melamine-formamide resin, acrylic resin, and fluorine-containing resins (e.g., polytetrafluoroethylene and polyvinylidene fluoride); complexes of organic compounds, such as rubber, wax and resin with inorganic compounds, such as metals, metal oxides, salts and carbon black; fluorine-containing inorganic compounds, such as fluorinated carbon; aliphatic acid metal salts, such as zinc stearate; aliphatic acids; aliphatic acid derivatives, such as aliphatic acid esters; and powdery lubricants such as molybdenum sulfide, amino acids, and amino acid derivatives.

Among these are preferred metal oxides and complex metal oxides inclusive of zinc oxide, aluminum oxide, titanium oxide, zirconium oxide, manganese oxide, strontium titanate, magnesium titanate and barium titanate.

The external additive particles (A) may preferably be prepared through particle size distribution adjusting treatments, such as pulverization and classification, so as to have a particle size distribution including a number-average circle-equivalent diameter of 0.60–4.00 μm, preferably 1.00–4.00 μm, more preferably 1.00–3.00 μm, and a % by number of particles having circle-equivalent diameters of at least 1.00 μm and below 1.03 μm and b % by number of particles having circle-equivalent diameters of at least 2.00 μm and below 2.06 μm satisfying: $-0.63 \leqq b-a \leqq 0.30$, respectively based on the flow particle image analyzer measurement. The classification process may preferably be a wet-classification process including sedimentation by means of, e.g., a centrifuge or a thickener.

Further, the toner particles before blending with the external additive particles (A) may preferably be subjected to a particle size distribution control so as to contain less than 10% by number of particles having circle-equivalent diameters of at least 2.00 μm based on the flow particle image analyzer measurement. If the toner particles in this particle size range are contained in more than 10% by number, the effect of the external additive particles (A) preventing the toner deterioration can be reduced.

As mentioned above, the toner according to the present invention has a particle size distribution based on the Coulter counter measurement including a weight-average particle size D4 of X μm and Y % by number of particles having sizes of 2.00–3.17 μm satisfying the conditions of:

$-5X+35 \leqq Y \leqq -25X+180$, and $3.5 \leqq X \leqq 6.5$.

When such a considerably small particle size toner is produced through a conventional classification process, it has been difficult to well remove toner particles of below 2.00 μm. Accordingly, in the present invention, it is preferred to remove such particles of below 2.00 μm as completely as possibly by applying a classification operation more precise or accurate than the conventional operation. For example, it is possible to apply plural times of (multi-division) classification by using pneumatic classifier, such as Elbow Jet, or applying a classification for removing a fine powder fraction as by a turbo-classifier after a pneumatic classification as by Elbow Jet.

More specifically, in the present invention, it is preferred to effect a precise classification for a particle size distribution adjustment so as to provide toner particles containing less than 1% by number of particles having circle-equivalent diameters of at least 1.00 μm and below 2.00 μm and blend the toner particles with external additive particles having a prescribed particle size distribution to provide the toner according to the present invention.

It is further preferred that the toner according to the present invention has a volume-average particle size (Dv) of 2.5–6.00 μm. In case of Dv<2.5 μm, it is difficult to obtain a sufficient image density. In case of Dv>6.0 μm, it is difficult to form images of higher definition.

The above-mentioned particle size distributions for defining the toner according to the present invention are based on the following Coulter counter measurement and flow particle image analyzer measurement.

<Coulter counter measurement>

Coulter counter "Model TA-II" (available from Coulter Electronics Inc.) is used, but it is also possible to use Coulter Multisizer (available from Coulter Electronics Inc.). A 1%-NaCl aqueous solution is prepared as an electrolytic solution by using a reagent-grade sodium chloride (it is also possible to use ISOTON R-II (available from Coulter Scientific Japan K. K.)). For the measurement, 0.1 to 5 ml of a surfactant, preferably a solution of an alkylbenzenesulfonic acid salt, is added as a dispersant into 100 to 150 ml of the electrolytic solution, and 2–20 mg of a sample toner is added thereto. The resultant dispersion of the sample in the electrolytic solution is subjected to a dispersion treatment for ca. 1–3 minutes by means of an ultrasonic disperser, and then subjected to measurement of particle size distribution in the range of 2.00–40.30 μm divided into 13 channels by using the above-mentioned Coulter counter with a 100 μm-aperture to obtain a volume-basis distribution and a number-basis distribution. From the volume-basis distribution, a weight-average particle size (D4) and a volume-average particle size (Dv) are calculated by using a central value as a representative value for each channel. From the number-basis distribution, a proportion (% by number) of particles of 2.00–3.17 μm is obtained.

The particle size range of 2.00–40.30 μm is divided into 13 channels of 2.00–2.52 μm; 2.52–3.17 μm; 3.17–4.00 μm; 4.00–5.04 μm; 5.04– 6.35 μm; 6.35–8.00 μm; 8.00–10.08 μm; 10.08–12.70 μm; 12.70–16.00 μm; 16.00–20.20 μm; 20.20–25.40 μm; 25.40–32.00 μm; and 32.00–40.30 μm. For each channel, the lower limit value is included, and the upper limit value is excluded.

<Flow particle image analyzer measurement>

A flow particle image analyzer ("FPIA-1000", available from Toa Iyou Denshi K. K.) is used for the measurement.

Into ca. 50 ml of water from which fine dirt has been removed by passing through a filter so as to reduce the number of contaminant particles (having particle sizes in the measurement range (i.e., circle-equivalent diameters of 0.60–159.21 μm)) to at most 20 particles, several drops of a surfactant (preferably an alkylbenzenesulfonic acid salt solution) is added as a dispersant, and ca. 2–20 mg of a sample is added, followed by ca. 1–3 min. of dispersion by means of an ultrasonic disperser, to form a sample dispersion liquid having a concentration of 4000–8000 particles/$10^{-3}$ $cm^3$ (based on particles in the measurement range). The sample dispersion liquid is subjected to measurement of particle size distribution in a circle-equivalent diameter range of 0.60–159.21 μm (upper limit, not inclusive).

The outline of the measurement (based on a technical brochure and an attached operation manual on "FPIA-1000" published from Toa Iyou Denshi K. K. (June 1995), and JP-A 8-136439) is as follows.

A sample dispersion liquid is caused to flow through a thin transparent flow cell (thickness=ca. 200 μm) having a divergent flow path A strobe and a CCD camera are disposed at mutually opposite positions with respect to the flow cell so as to form an optical path passing across the thickness of the flow cell. During the flow of the sample dispersion liquid, the strobe is flashed at intervals of 1/30 second each to capture images of particles passing through the flow cell, so that each particle provides a two-dimensional image having a certain area parallel to the flow cell. From the two-dimensional image area of each particle, a diameter of a circle having an identical area is determined as a circle-equivalent diameter. During ca. 1 min., circle-equivalent diameters of more than 1200 particles can be determined, from which a number basis circle-equivalent diameter distribution, and a proportion (% by number) of particles having a prescribed circle-equivalent diameter range can be determined. (As a specific example, in the case of a toner dispersion liquid containing ca. 6000 particles/$10^{-3}$ $cm^3$, the diameters of ca. 1800 particles can be determined in ca. 1 min.) The results (frequency % and cumulative %) may be given for 226 channels in the range of 0.60 μm–400.00 μm (80 channels (divisions) for one octave) as shown in the following Table 1 (for each channel, the lower limit size value is included and the upper limit size value is excluded), whereas particles having circle-equivalent diameters in a range of 0.60 μm–159.21 μm (upper limit, not inclusive) are subjected to an actual measurement.

TABLE 1

| Circle-equivalent diameter (C.E.D.) ranges for respective channels (Ch) | |
|---|---|
| Ch | C.E.D. range (μm) |
| 1 | 0.60–0.61 |
| 2 | 0.61–0.63 |
| 3 | 0.63–0.65 |
| 4 | 0.65–0.67 |
| 5 | 0.67–0.69 |
| 6 | 0.69–0.71 |
| 7 | 0.71–0.73 |
| 8 | 0.73–0.75 |
| 9 | 0.75–0.77 |
| 10 | 0.77–0.80 |
| 11 | 0.80–0.82 |
| 12 | 0.82–0.84 |
| 13 | 0.84–0.87 |
| 14 | 0.87–0.89 |
| 15 | 0.89–0.92 |
| 16 | 0.92–0.95 |
| 17 | 0.95–0.97 |
| 18 | 0.97–1.00 |
| 19 | 1.00–1.03 |

TABLE 1-continued

| Circle-equivalent diameter (C.E.D.) ranges for respective channels (Ch) | |
|---|---|
| Ch | C.E.D. range (μm) |
| 20 | 1.03–1.06 |
| 21 | 1.06–1.09 |
| 22 | 1.09–1.12 |
| 23 | 1.12–1.16 |
| 24 | 1.16–1.19 |
| 25 | 1.19–1.23 |
| 26 | 1.23–1.26 |
| 27 | 1.26–1.30 |
| 28 | 1.30–1.34 |
| 29 | 1.34–1.38 |
| 30 | 1.38–1.42 |
| 31 | 1.42–1.46 |
| 32 | 1.46–1.50 |
| 33 | 1.50–1.55 |
| 34 | 1.55–1.59 |
| 35 | 1.59–1.64 |
| 36 | 1.64–1.69 |
| 37 | 1.69–1.73 |
| 38 | 1.73–1.79 |
| 39 | 1.79–1.84 |
| 40 | 1.84–1.89 |
| 41 | 1.89–1.95 |
| 42 | 1.95–2.00 |
| 43 | 2.00–2.06 |
| 44 | 2.06–2.12 |
| 45 | 2.12–2.18 |
| 46 | 2.18–2.25 |
| 47 | 2.25–2.31 |
| 48 | 2.31–2.38 |
| 49 | 2.38–2.45 |
| 50 | 2.45–2.52 |
| 51 | 2.52–2.60 |
| 52 | 2.60–2.67 |
| 53 | 2.67–2.75 |
| 54 | 2.75–2.83 |
| 55 | 2.83–2.91 |
| 56 | 2.91–3.00 |
| 57 | 3.00–3.09 |
| 58 | 3.09–3.18 |
| 59 | 3.18–3.27 |
| 60 | 3.27–3.37 |
| 61 | 3.37–3.46 |
| 62 | 3.46–3.57 |
| 63 | 3.57–3.67 |
| 64 | 3.67–3.78 |
| 65 | 3.78–3.89 |
| 66 | 3.89–4.00 |
| 67 | 4.00–4.12 |
| 68 | 4.12–4.24 |
| 69 | 4.24–4.36 |
| 70 | 4.36–4.49 |
| 71 | 4.49–4.62 |
| 72 | 4.62–4.76 |
| 73 | 4.76–4.90 |
| 74 | 4.90–5.04 |
| 75 | 5.04–5.19 |
| 76 | 5.19–5.34 |
| 77 | 5.34–5.49 |
| 78 | 5.49–5.65 |
| 79 | 5.65–5.82 |
| 80 | 5.82–5.99 |
| 81 | 5.99–6.16 |
| 82 | 6.16–6.34 |
| 83 | 6.34–6.53 |
| 84 | 6.53–6.72 |
| 85 | 6.72–6.92 |
| 86 | 6.92–7.12 |
| 87 | 7.12–7.33 |
| 88 | 7.33–7.54 |
| 89 | 7.54–7.76 |
| 90 | 7.76–7.99 |
| 91 | 7.99–8.22 |
| 92 | 8.22–8.46 |
| 93 | 8.46–8.71 |

TABLE 1-continued

| Circle-equivalent diameter (C.E.D.) ranges for respective channels (Ch) | |
|---|---|
| Ch | C.E.D. range (μm) |
| 94 | 8.71–8.96 |
| 95 | 8.96–9.22 |
| 96 | 9.22–9.49 |
| 97 | 9.49–9.77 |
| 98 | 9.77–10.05 |
| 99 | 10.05–10.35 |
| 100 | 10.35–10.65 |
| 101 | 10.65–10.96 |
| 102 | 10.96–11.28 |
| 103 | 11.28–11.61 |
| 104 | 11.61–11.95 |
| 105 | 11.95–12.30 |
| 106 | 12.30–12.66 |
| 107 | 12.66–13.03 |
| 108 | 13.03–13.41 |
| 109 | 13.41–13.80 |
| 110 | 13.80–14.20 |
| 111 | 14.20–14.62 |
| 112 | 14.62–15.04 |
| 113 | 15.04–15.48 |
| 114 | 15.48–15.93 |
| 115 | 15.93–16.40 |
| 116 | 16.40–16.88 |
| 117 | 16.88–17.37 |
| 118 | 17.37–17.88 |
| 119 | 17.88–18.40 |
| 120 | 18.40–18.94 |
| 121 | 18.94–19.49 |
| 122 | 19.49–20.06 |
| 123 | 20.06–20.65 |
| 124 | 20.65–21.25 |
| 125 | 21.25–21.87 |
| 126 | 21.87–22.51 |
| 127 | 22.51–23.16 |
| 128 | 23.16–23.84 |
| 129 | 23.84–24.54 |
| 130 | 24.54–25.25 |
| 131 | 25.25–25.99 |
| 132 | 25.99–26.75 |
| 133 | 26.75–27.53 |
| 134 | 27.53–28.33 |
| 135 | 28.33–29.16 |
| 136 | 29.16–30.01 |
| 137 | 30.01–30.89 |
| 138 | 30.89–31.79 |
| 139 | 31.79–32.72 |
| 140 | 32.72–33.67 |
| 141 | 33.67–34.65 |
| 142 | 34.65–35.67 |
| 143 | 35.67–36.71 |
| 144 | 36.71–37.78 |
| 145 | 37.78–38.88 |
| 146 | 38.88–40.02 |
| 147 | 40.02–41.18 |
| 148 | 41.18–42.39 |
| 149 | 42.39–43.62 |
| 150 | 43.62–44.90 |
| 151 | 44.90–46.21 |
| 152 | 46.21–47.56 |
| 153 | 47.56–48.94 |
| 154 | 48.94–50.37 |
| 155 | 50.37–51.84 |
| 156 | 51.84–53.36 |
| 157 | 53.36–54.91 |
| 158 | 54.91–56.52 |
| 159 | 56.52–58.17 |
| 160 | 58.17–59.86 |
| 161 | 59.86–61.61 |
| 162 | 61.61–63.41 |
| 163 | 63.41–65.26 |
| 164 | 65.26–67.16 |
| 165 | 67.16–69.12 |
| 166 | 69.12–71.14 |
| 167 | 71.14–73.22 |

TABLE 1-continued

| Circle-equivalent diameter (C.E.D.) ranges for respective channels (Ch) | |
|---|---|
| Ch | C.E.D. range (μm) |
| 168 | 73.22–75.36 |
| 169 | 75.36–77.56 |
| 170 | 77.56–79.82 |
| 171 | 79.82–82.15 |
| 172 | 82.15–84.55 |
| 173 | 84.55–87.01 |
| 174 | 87.01–89.55 |
| 175 | 89.55–92.17 |
| 176 | 92.17–94.86 |
| 177 | 94.86–97.63 |
| 178 | 97.63–100.48 |
| 179 | 100.48–103.41 |
| 180 | 103.41–106.43 |
| 181 | 106.43–109.53 |
| 182 | 109.53–112.73 |
| 183 | 112.73–116.02 |
| 184 | 116.02–119.41 |
| 185 | 119.41–122.89 |
| 186 | 122.89–126.48 |
| 187 | 126.48–130.17 |
| 188 | 130.17–133.97 |
| 189 | 133.97–137.88 |
| 190 | 137.88–141.90 |
| 191 | 141.90–146.05 |
| 192 | 146.05–150.31 |
| 193 | 150.31–154.70 |
| 194 | 154.70–159.21 |
| 195 | 159.21–163.86 |
| 196 | 163.86–168.64 |
| 197 | 168.64–173.56 |
| 198 | 173.56–178.63 |
| 199 | 178.63–183.84 |
| 200 | 183.84–189.21 |
| 201 | 189.21–194.73 |
| 202 | 194.73–200.41 |
| 203 | 200.41–206.26 |
| 204 | 206.26–212.28 |
| 205 | 212.28–218.48 |
| 206 | 218.48–224.86 |
| 207 | 224.86–231.42 |
| 208 | 231.42–238.17 |
| 209 | 238.17–245.12 |
| 210 | 245.12–252.28 |
| 211 | 252.28–259.64 |
| 212 | 259.64–267.22 |
| 213 | 267.22–275.02 |
| 214 | 275.02–283.05 |
| 215 | 283.05–291.31 |
| 216 | 291.31–299.81 |
| 217 | 299.81–308.56 |
| 218 | 308.56–317.56 |
| 219 | 317.56–326.83 |
| 220 | 326.83–336.37 |
| 221 | 336.37–346.19 |
| 222 | 346.19–356.29 |
| 223 | 356.29–366.69 |
| 224 | 366.69–377.40 |
| 225 | 377.40–388.41 |
| 226 | 388.41–400.00 |

Figure 1B:
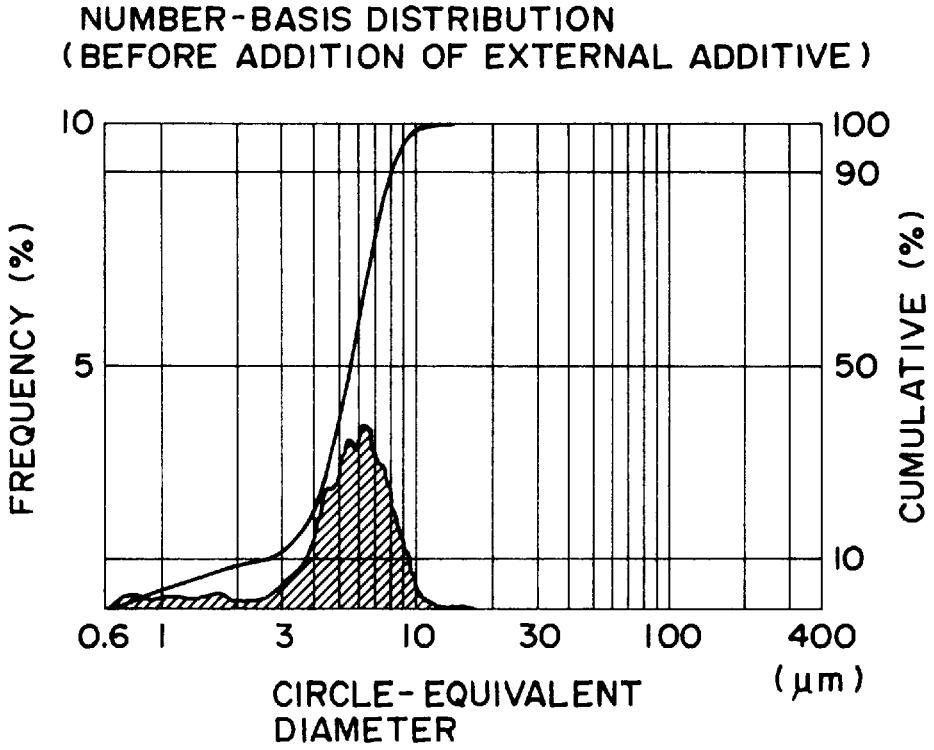

Examples of circle-equivalent diameter distributions thus obtained for a toner of Example 12 before and after blending with external additive particles are given in FIGS. 1A and 1B, respectively.

The toner according to the present invention may preferably have a tap void as defined by the following formula of 0.45–0.70, further preferably 0.50–0.70 so as to exhibit a good chargeability:

$$\text{tap void}=(\text{true density}-\text{tap density})/\text{true density}.$$

A toner is triboelectrically charged principally in a state of being packed between a toner carrying member and a toner regulating blade. Accordingly, the degree of toner packing largely affects the charge of the toner. A tap void (i.e., a void after tapping as a measure of a packing state) in the above-described range provides individual toner particles with equal opportunity of charging, so that a fluctuation in triboelectric charge of individual toner particles is suppressed to allow an image density and a freeness from fog adjusted at high levels.

In the above formula, the measurement of a tap density may be performed by using a powder tester ("Powder Tester", available from Hosokawa Micron K. K.) together with an accessory cup in a manner described in the handling manual for the powder tester.

The true density of a toner may be measured by placing 1 g of a toner sample in a mold for forming a tablet for IR measurement, shaping the toner into a tablet under application of a pressure of ca. 1.6 MPa (200 kg.f/cm$^2$) for 1 min., and measuring the volume and weight of the tablet to calculate therefrom a true density of the toner.

The binder resin for the toner of the present invention may for example comprise: homopolymers of styrene and derivatives thereof, such as polystyrene, poly-p-chlorostyrene and polyvinyltoluene; styrene copolymers, such as styrene-p-chlorostyrene copolymer, styrene-vinyltoluene copolymer, styrene-vinylnaphthalene copolymer, styrene-acrylate copolymer, styrene-methacrylate copolymer, styrene-methyl-α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer and styrene-acrylonitrile-indene copolymer; polyvinyl chloride, phenolic resin, natural resin-modified phenolic resin, natural resin-modified maleic acid resin, acrylic resin such as polyacrylic acid and polyacrylic acid ester, methacrylic resin such as polymethacrylic acid and polymethacrylic acid ester, polyvinyl acetate, silicone resin, polyester resin, polyurethane, polyamide resin, furan resin, epoxy resin, xylene resin, polyvinyl butyral, terpene resin, coumarone-indene resin and petroleum resin. It is also preferred to use crosslinked styrene resins.

Examples of the comonomer constituting a styrene copolymer together with styrene monomer may include other vinyl monomers inclusive of: monocarboxylic acids having a double bond and derivative thereof, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond and derivatives thereof, such as maleic acid, butyl maleate, methyl maleate and dimethyl maleate; vinyl esters, such as vinyl chloride, vinyl acetate, and vinyl benzoate; ethylenic olefins, such as ethylene, propylene and butylene; vinyl ketones, such as vinyl methyl ketone and vinyl hexyl ketone; and vinyl ethers, such as vinyl methyl ether, vinyl ethyl ether, and vinyl isobutyl ether. These vinyl monomers may be used alone or in mixture of two or more species in combination with the styrene monomer.

It is possible that the binder resin inclusive of styrene polymers or copolymers has been crosslinked or can assume a mixture of crosslinked and un-crosslinked polymers.

The crosslinking agent may principally be a compound having two or more double bonds susceptible of polymerization, examples of which may include: aromatic divinyl compounds, such as divinylbenzene, and divinylnaphthalene; carboxylic acid esters having two double bonds, such as ethylene glycol diacrylate, ethylene glycol dimethacrylate and 1,3-butanediol dimethacrylate; divinyl compounds, such as divinylaniline, divinyl ether, divinyl sulfide and divinylsulfone; and compounds having three or more vinyl groups. These may be used singly or in mixture.

The binder resin for the toner according to the present invention may comprise a high molecular weight component and a low molecular weight component.

Such a high molecular weight component may be prepared by emulsion polymerization or suspension polymerization.

Of these, in the emulsion polymerization method, a monomer almost insoluble in water is dispersed as minute particles in an aqueous phase with the aid of an emulsifier and is polymerized by using a water-soluble polymerization initiator. According to this method, the control of the reaction temperature is easy, and the termination reaction velocity is small because the polymerization phase (an oil phase of the vinyl monomer possibly containing a polymer therein) constitute a separate phase from the aqueous phase. As a result, the polymerization velocity becomes large and a polymer having a high polymerization degree can be prepared easily. Further, the polymerization process is relatively simple, the polymerization product is obtained in fine particles, and additives such as a colorant, a charge control agent and others can be blended easily for toner production. Therefore, this method includes an advantageous point for production of a toner binder resin.

In the emulsion polymerization, however, the emulsifier added is liable to be incorporated as an impurity in the polymer produced, and it is necessary to effect a post-treatment such as salt-precipitation in order to recover the product polymer. The suspension polymerization is more convenient in this respect.

The suspension polymerization may preferably be performed by using at most 100 wt. parts, preferably 10–90 wt. parts, of a monomer (mixture) per 100 wt. parts of water or an aqueous medium. The dispersing agent may include polyvinyl alcohol, partially saponified form of polyvinyl alcohol, and calcium phosphate, and may preferably be used in an amount of 0.05–1 wt. part per 100 wt. parts of the aqueous medium while the amount is affected by the amount of the monomer relative to the aqueous medium. The polymerization temperature may suitably be in the range of 50–95° C. and selected depending on the polymerization initiator used and the objective polymer. The polymerization initiator should be insoluble or hardly soluble in water, and may be used in an amount of at least 0.05 wt. part, preferably 0.1–15 wt. parts per 100 wt. parts of the vinyl monomer (mixture).

A low-molecular weight component of the binder resin may be synthesized through a known polymerization process. In the bulk polymerization, it is possible to obtain a low-molecular weight polymer by performing the polymerization at a high temperature so as to accelerate the termination reaction, but there is a difficulty that the reaction control is difficult. In the solution polymerization, it is possible to obtain a low-molecular weight polymer or copolymer under moderate conditions by utilizing a radical chain transfer function depending on a solvent used or by selecting the polymerization initiator or the reaction temperature. Accordingly, the solution polymerization is preferred for preparation of a low-molecular weight polymer or copolymer used in the binder resin of the present invention. Particularly, the solution polymerization is advantageously combined with a post treatment of mixing polymers of different molecular weights or compositions to provide a low-molecular weight component, or a post treatment of adding monomers of different compositions for further polymerization so as to further control an acidity or molecular weight.

The solvent used in the solution polymerization may for example include xylene, toluene, cumene, cellosolve acetate, isopropyl alcohol, and benzene. It is preferred to use xylene, toluene or cumene for a styrene monomer mixture. The solvent may be appropriately selected depending on the polymer produced by the polymerization.

The toner particles constitutes the toner according to the present invention may preferably contain a wax, examples of which may include: paraffin waxes and derivatives thereof, microcrystalline wax and derivatives thereof, Fischer-Tropsche wax and derivatives thereof, polyolefin wax and derivatives thereof, and carnauba wax and derivative thereof. The derivatives may include an oxide, a block copolymer with a vinyl monomer, and a graft-product modified with a vinyl monomer.

A preferred class of waxes used in the present invention may include those represented by the following formula:

$$R—Y,$$

wherein R denotes a hydrocarbon group, and Y denotes hydrogen atom, hydroxyl group, carboxyl group, alkyl ether group, ester group or sulfonyl group.

The wax compounds represented by the formula of R—Y may preferably have a weight-average molecular weight (Mw) of at most 3000, more preferably 500–2500.

Specific examples of this class of wax compounds may include those represented by the following formulae (A)–(C):

$$CH_3(CH_2)_nCH_2OH \ (n=20–300) \quad (A)$$

$$CH_3(CH_2)^nCH_2COOH \ (n=20–300) \quad (B)$$

$$CH_3(CH_2)_nCH_2OCH_2(CH_2)_mCH_3 \ (n=20–200,\ m=0–100) \quad (C)$$

(B) and (C) compounds may be derived from (A) compounds, and all these compounds have a main chain of linear hydrocarbon. Other compounds derivable from (A) compounds other than (B) and (C) compounds may also be used. By using a wax as described above, the toner according to the present invention may be provided with higher degrees of low-temperature fixability and anti-high-temperature offset characteristic.

Among the above-described compounds, it is particularly preferred to use a wax comprising a polymeric alcohol as represented by the above formula (A) as a principal component. Such a wax shows a good slippability and provides particularly excellent anti-offset characteristic.

<Wax molecular weight distribution>

The molecular weight distribution of hydrocarbon wax may be obtained based on measurement by GPC (gel permeation chromatography), e.g., under the following conditions:

Apparatus: "GPC-150C" (available from Waters Co.)

Column: "GMH-HT" 30 cm-binary (available from Toso K. K.)

Temperature: 135° C.

Solvent: o-dichlorobenzene containing 0.1% of ionol.

Flow rate: 1.0 ml/min.

Sample: 0.4 ml of a 0.15 wt. %-sample.

Based on the above GPC measurement, the molecular weight distribution of a sample is obtained once based on a calibration curve prepared by monodisperse polystyrene standard samples, and re-calculated into a distribution corresponding to that of polyethylene using a conversion formula based on the Mark-Houwink viscosity formula.

Such a wax may be used in a proportion of 0.5–20 wt. parts per 100 wt. parts of the binder resin.

The toner according to the present invention may preferably be constituted as a magnetic toner containing a magnetic material. The magnetic material may preferably be contained in 30–20 wt. parts, more preferably 50–150 wt. parts, per 100 wt. parts of the binder resin.

The toner according to the present invention may further preferably be constituted as a negatively chargeable magnetic toner by adding a negative charge control agent.

Examples of such a negative charge control agent may include: metal complexes of mono-azo dyes disclosed in JP-B 41-20153, JP-B 42-27596, JP-B 44-6397 and JP-B 45-26478; nitroamine acids and salts thereof disclosed in JP-A 50-133338; dyes or pigments, such as C.I. 14645; complexes of metals, such as Zn, Al, Co, Cr and Fe with salicylic acid, naphthoic acid and dicarboxylic acids; sulfonated copper phthalocyanine pigments; styrene oligomers having a nitro or halogen group introduced therein; and chlorinated paraffin. Particularly, in view of excellent dispersibility and effects of providing stable image density and reducing the fog, it is preferred to use an azo-type metal complex represented by formula (I) below or a basic organo-acid metal complex represented by formula (II) below:

(I)

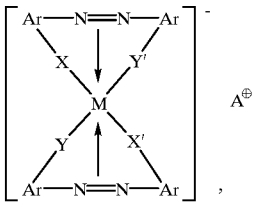

wherein M denotes a coordination center metal, such as Cr, Co, Ni, Mn, Fe, Ti or Al; Ar denotes an aryl group, such as phenyl or naphthyl, capable of having a substituent, examples of which may include: nitro, halogen, carboxyl, anilide, and alkyl and alkoxy having 1–18 carbon atoms; X, X', Y and Y' independently denote —O—, —CO—, —NH—, or —NR— (wherein R denotes an alkyl having 1–4 carbon atoms); and $A^{\oplus}$ denotes hydrogen, sodium, potassium, ammonium or aliphatic ammonium.

(II)

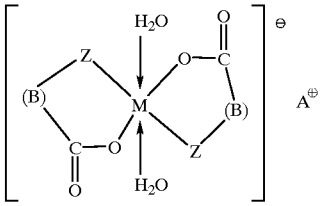

wherein M denotes a coordination center metal, such as Cr, Co, Ni, Mn, Fe, Ti and Al; B denotes

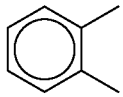

(capable of having an alkyl as a substituent),

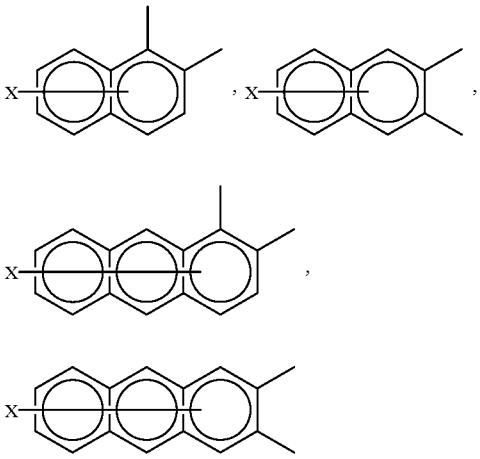

(X denotes hydrogen, halogen or nitro),

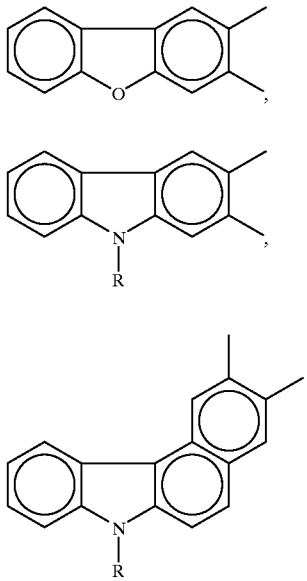

(R denotes hydrogen, $C_1$–$C_{18}$ alkyl or $C_1$–$C_{18}$ alkenyl); $A^{\oplus}$ denotes a counter ion, such as hydrogen, sodium, potassium, ammonium, or aliphatic ammonium; and Z denotes —O— or —CO—O—.

Among the above, the azo-type metal complexes represented by the above formula (I) are preferred, and azo-type iron complexes having Fe as the center metal and represented by the following formula (III) are most preferred.

(III)

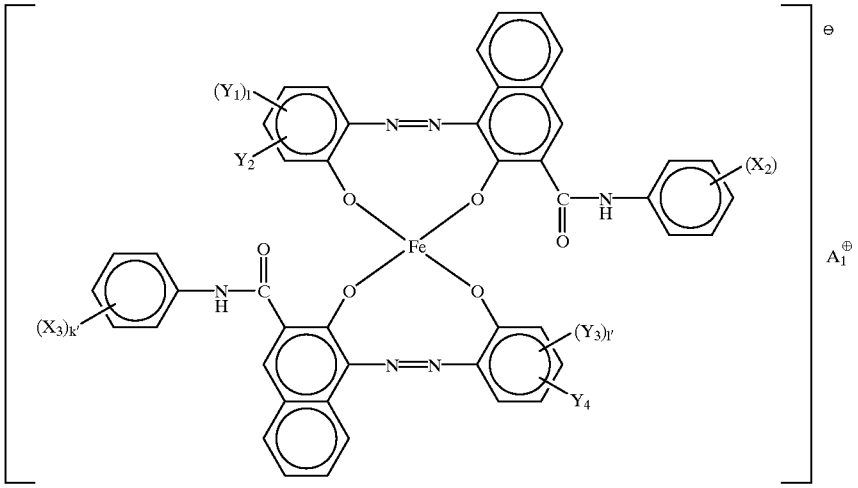

wherein $X_2$ and $X_3$ independently denote hydrogen, lower alkyl, lower alkoxy, nitro or halogen, k and k' are independently integers of 1–3, $Y_1$ and $Y_3$ independently denote hydrogen, $C_1$–$C_{18}$ alkyl, $C_2$–$C_{18}$ alkenyl, sulfonamide, mesyl, sulfonic acid, carboxy ester, hydroxy, $C_1$–$C_{18}$ alkoxy, acetylamino, benzoyl, amino or halogen.

1 and 1' are independently integers of 1–3, $Y_2$ and $Y_4$ are independently hydrogen or nitro, and $A^+$ denotes ammonium ion, alkali metal ion, hydrogen ion or a mixture of two or more of these ions.

Specific examples of the azo-type iron complexes may include the following:

Azo iron complex (1):

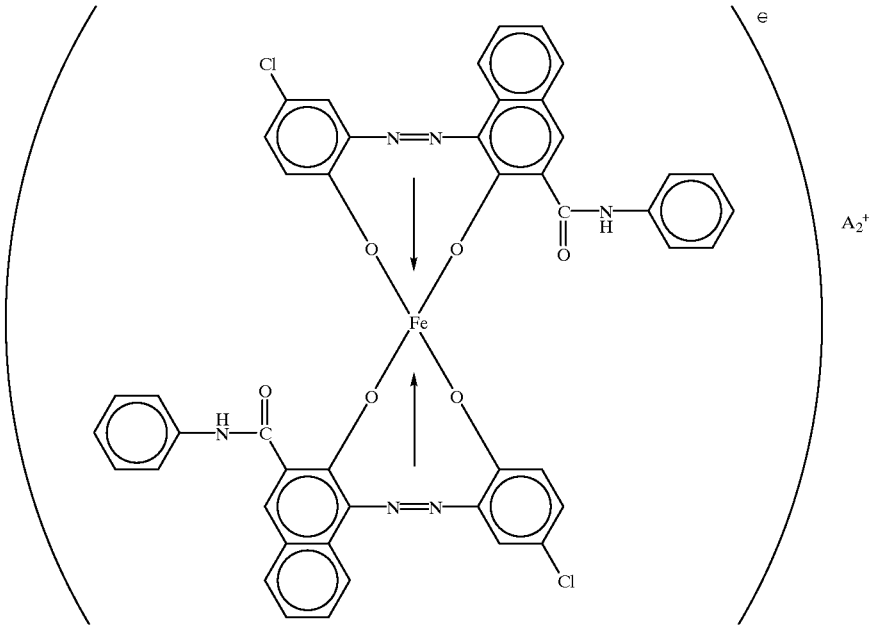

-continued
Azo iron complex (2):
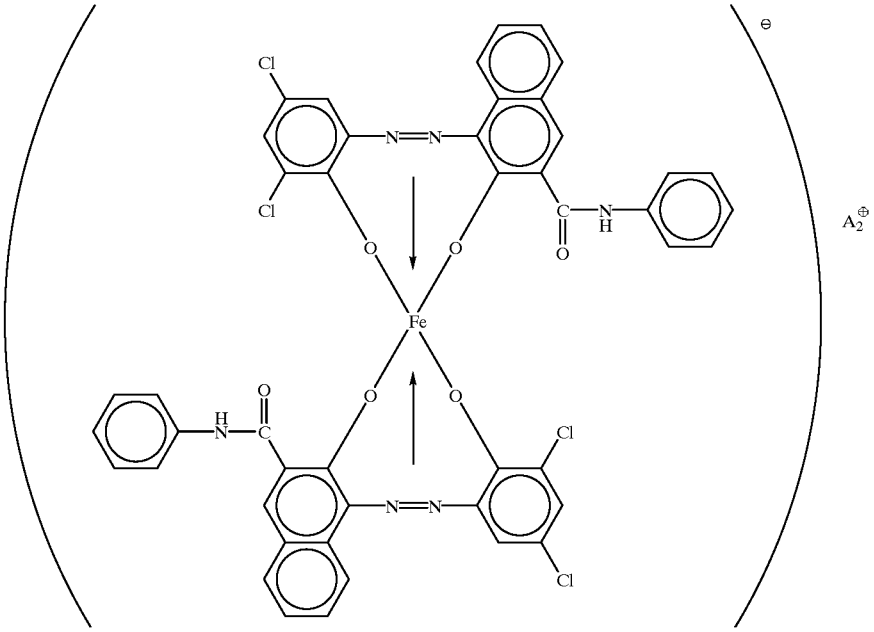
Azo iron complex (3):
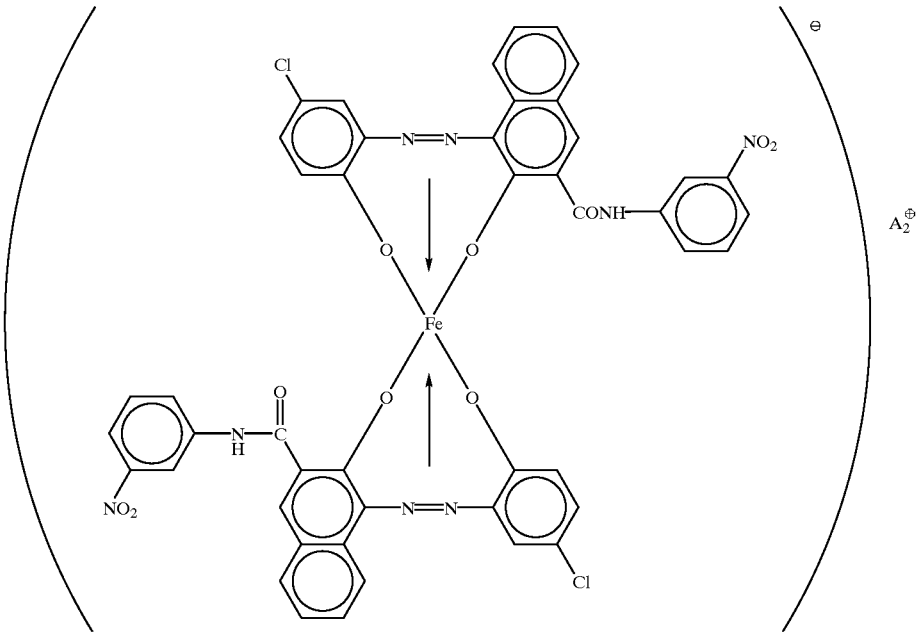

-continued
Azo iron complex (4):
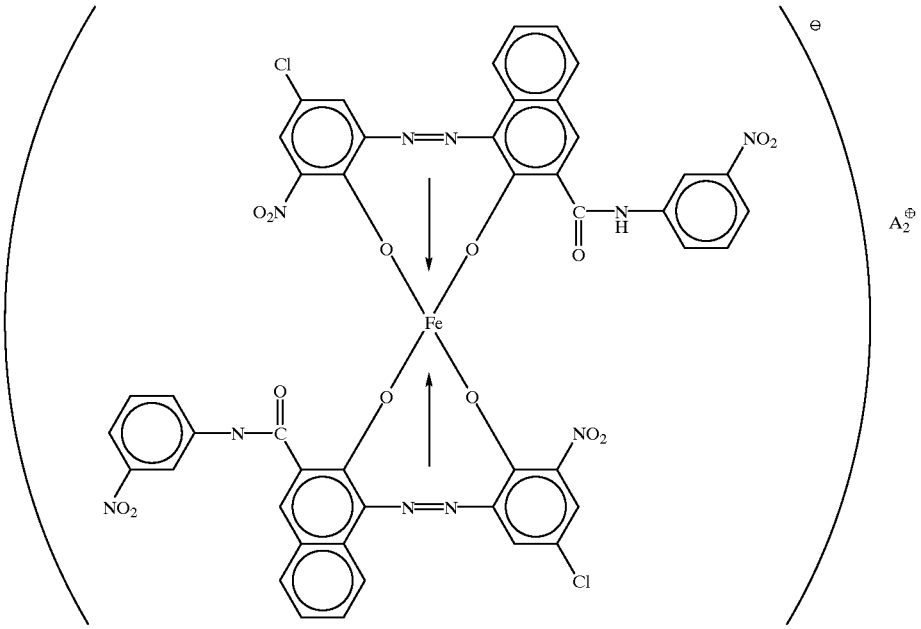
Azo iron complex (5):
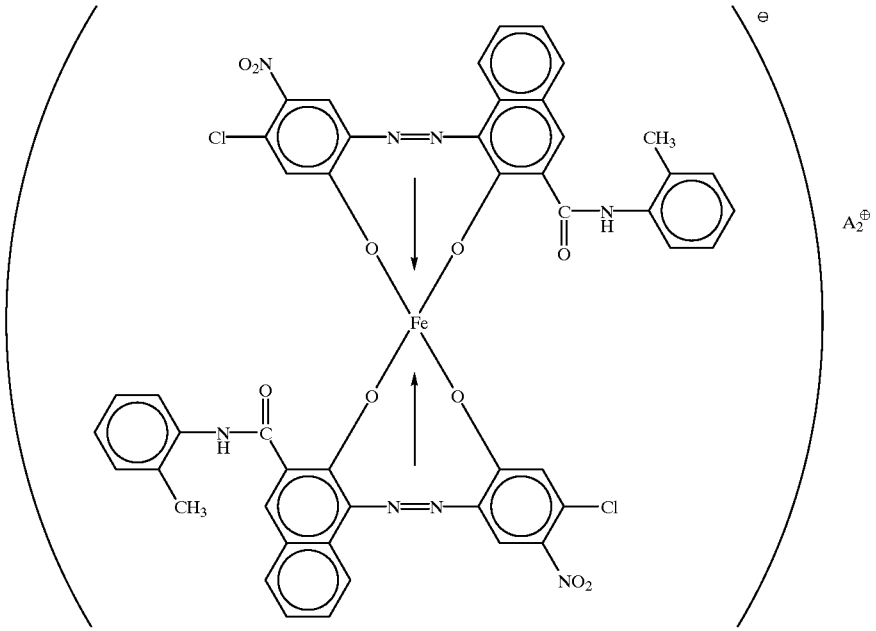

-continued

Azo iron complex (6):

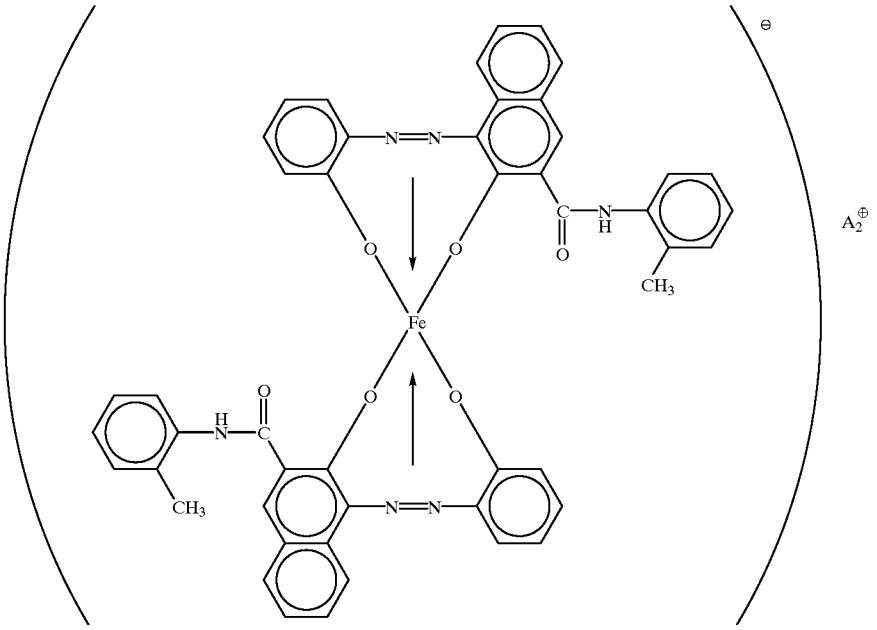

In each of the formulae representing Azo iron complexes (1) to (6), $A_2^+$ denotes $NH_4^+$, $H^+$, $Na^+$, $K^+$ or a mixture of two or more of these ions.

In the toner of the present invention, such a charge control agent may preferably be used in an amount of 0.1–5 wt. parts, more preferably 0.2–3 wt. parts, per 100 wt. parts of the binder resin. An excessive amount of charge control agent is liable to result in an inferior flowability and fog, and a lower amount leads to a difficulty in obtaining a sufficient chargeability.

In the toner of the present invention, it is also preferred to add hydrophillic or hydrophobic inorganic fine powder as external additive particles (B) for improving the environmental stability, charge stability, developing performance, flowability and storability in addition to the above-mentioned external additive particles (A). Examples of such inorganic fine powder (B) may include: silica fine powder, titanium oxide fine powder, and hydrophobized products thereof. These fine powders may be used singly or in mixture of two or more species thereof.

Silica fine powder may be dry process silica (sometimes called fumed silica) formed by vapor phase oxidation of a silicon halide or wet process silica formed from water glass. However, dry process silica is preferred because of fewer silanol groups at the surface and inside thereof and also fewer production residues such as $Na_2O_3$ and $SO_3^{2-}$. The dry process silica can be in the form of complex metal oxide powder with other metal oxides for example by using another metal halide, such as aluminum chloride or titanium chloride together with silicon halide in the production process. Silica fine powder herein may include such complex metal oxide powder.

Silica fine powder may preferably be made hydrophobic through a hydrophobization treatment. Such a hydrophobization treatment may be effected by treating silica fine powder with a chemical agent, such as an organosilicon compound, reactive with or physically adsorbable by silica fine powder. A preferred example of hydrophobization process may comprise treating dry process silica fine powder formed through vapor-phase oxidation of a silicon halide with a silane coupling agent and, thereafter or simultaneously therewith, treating the silica fine powder with an organosilicon compound, such as silicone oil.

Examples of such a silane coupling agent used for the hydrophobization may include: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptans such as trimethylsilylmercaptan, triorganosilyl acrylates, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units per molecule and containing each one hydroxyl group bonded to Si at the terminal units. These may be used alone or as a mixture of two or more compounds.

Silicone oil as a preferred class of organosilicon compound for hydrophobization may preferably have a viscosity at 25° C. of ca. 30–1,000 cSt (centi-Stokes). Particularly preferred examples thereof may include: dimethylsilicone oil, methylphenylsilicone oil, α-methylstyrene-modified silicone oil, chlorophenylsilicone oil, and fluorine-containing silicone oil.

The silicone oil treatment may be performed, e.g., by directly blending silica fine powder preliminarily treated with a silane coupling agent and silicone oil by means of a blender such as a Henschel mixer; by spraying silicone oil onto base silica fine powder; or by dissolving or dispersing silicone oil in an appropriate solvent and adding thereto silica fine powder for blending, followed by removal of the solvent.

The thus-treated inorganic fine powder as external additive particles (B) may preferably have a number-average primary particle size of 0.002–0.2 μm so as to provide the toner with good charging stability and improved flowability.

It is further preferred that the toner according to the present invention further contains fine powder agglomerate particles, having a silicone oil or silicone varnish content of 20–90 wt. % as external additive particles (C) in order to prevent transfer dropout (hollow image formation) and melt-sticking of the toner onto the photosensitive drum.

Such fine powder agglomerate particles (C) may comprise fine powder of an organic compound or an inorganic compound. Examples of the organic compound may include: resins, such as styrene resin, acrylic resin, silicone resin, silicone rubber, polyester resin, urethane resin, polyamide resin, polyethylene resin and fluorine-containing resin, and aliphatic compounds.

Examples of the inorganic compound may include: metal oxides, such as $SiO_2$, $GeO_2$, $TiO_2$, $SnO_2$, $Al_2O_3$, $B_2O_3$, $P_2O_5$ and $As_2O_3$; metal oxide salts, such as silicates, borates, phosphates, germanates, borosilicates, aluminosilicates, aluminoborates, aluminoborosilicates, tungstenates, molybdenates, and tellurates; complex compounds of the above; silicon carbide, silicon nitride, and amorphous carbon. These may be used singly or in mixture.

Among the above, metal oxides are preferred, and oxides or complex oxides of a metal selected from the group consisting of Si, Al and Ti are particularly preferred. It is possible that the fine powders have been subjected to a hydrophobization treatment.

Silicone oil used in the present invention may preferably be one having a structure represented by the following formula (IV):

(IV)

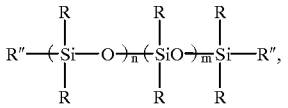

wherein R denotes alkyl having 1–3 carbon atoms,

R' denotes a silicone oil-modifying group selected from alkyl, halogenated alkyl, phenyl or modified phenyl; and R" denotes alkyl or alkoxy having 1–3 carbon atoms.

Examples of the silicone oil may include: dimethylsilicone oil, methylphenylsilicone oil, α-methylstyrene-modified silicone oil, chlorophenylsilicone oil, and fluorine-containing silicone oil.

Amino-modified silicone oil having a structure represented by the following formula (V) can also be used as a class of the silicone oil usable in the present invention:

(V)

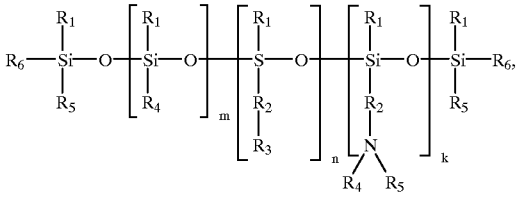

wherein $R_1$ and $R_6$ denote hydrogen, alkyl, aryl or alkoxy; $R_2$ denotes alkylene, phenylene or nothing; $R_3$ denotes a group including a nitrogen-containing heterocyclic ring; and $R_4$ and $R_5$ denote hydrogen, alkyl or aryl. The above-mentioned alkyl, aryl, alkylene and phenylene groups can contain an amine unit or have a halogen substituent within an extent of adversely affecting the chargeability. m is a number of at least 1, and n and k are a positive number or 0, giving a total (=n+k) of at least 1.

Among those represented by the above formula (V), one having a nitrogen-containing side chain containing 1 or 2 nitrogen atoms is preferred.

Examples of unsaturated heterocyclic rings may include the following:

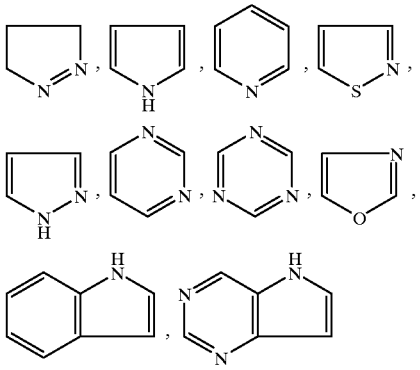

Examples of saturated heterocyclic rings may include the following:

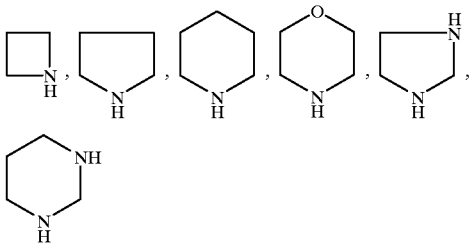

It is preferred to use a compound having a 5-membered ring or a 6-membered heretocyclic ring.

Examples of available derivatives may be obtained by introducing a hydrocarbon group, halogen, amino group, vinyl group, mercapto group, methacryl group, glycidoxy group, or ureido group into the above-mentioned silicone oil compounds.

These silicone oil compounds may be used singly or in mixture of two or more species.

Examples of the silicone varnish may include methylsilicone varnish and phenylmethylsilicone varnish. Methylsilicone varnish is particularly preferred.

Methylsilicone varnish is a polymer comprising the following $T^{31}$ unit, $D^{31}$ unit and $M^{31}$ unit and is a three-dimensional polymer containing a large proportion of the $T^{31}$ unit:

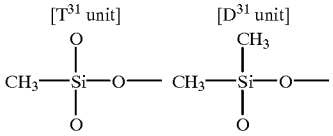

-continued

[$M^{31}$ unit]

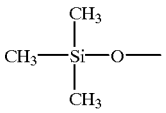

As a whole, methylsilicone varnish or phenylmethylsilicone varnish may have a structure shown by the following formula (VI):

(VI)

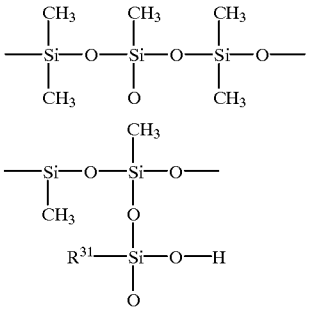

wherein $R^{31}$ denotes a methyl or phenyl group.

In the above-mentioned silicone varnish, the $T^{31}$ unit is effective for providing a good heat-curability and a three-dimensional network structure. The $T^{31}$ unit may preferably be contained in a proportion of 10–90 mol. %, particularly 30–80 mol. %, in the silicone varnish.

Such a silicone varnish has hydroxyl groups at its molecular chain terminal or in side chains and is cured by dehydro-condensation of the hydroxyl groups. The curing reaction may be promoted by using a curing promoter, examples of which may include: aliphatic acid salts of zinc, lead, cobalt, tin, etc.; and amines, such as triethanolamine, and butylamine. Of these, amines may be particularly preferably used.

The above-mentioned silicone varnish may be converted into an amino-modified silicone varnish by substituting an amino group-containing group for a portion of methyl groups or phenyl groups in the $T^{31}$, $D^{31}$ and $M^{31}$ units. Examples of such amino group-containing group may include those having structures of the following formulae (VII)–(XI):

(VII)

$$—CH_2CH_2—NH_2$$

(VIII)

$$—CH_2(CH_2)_2—NH_2$$

(IX)

$$—CH_2(CH_2)_2—NH—(CH_2)_3—NH_2$$

(X)

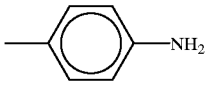

(XI)

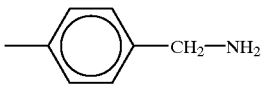

The silicone oil or silicon varnish may preferably have a viscosity at 25° C. of 50–200,000 cSt (centi-Stokes), more preferably 500–150,000 cSt, further preferably 1,500–100,000 cSt, further more preferably 3,000–80,000 cSt.

Below 50 cSt, it is difficult to effect particle formation from a large proportion of silicone oil or varnish, and the resultant fine powder agglomerate particles (C) are liable to be unstable and cause image quality deterioration due to thermal and mechanical stresses.

In excess of 200,000 cSt, the particle formation from the silicone oil or varnish is liable to be difficult.

The viscosity measurement of silicone oil or varnish may be performed by using a visco-tester ("VT-500", available from Haake Mass-Tachnik GmbH). One of several viscosity sensors for "VT-500" is selected depending on a viscosity level, and a measurement sample is placed in a cell for the sensor to effect the measurement. The measured viscosity may be indicated in "Pa.s", which may be readily converted into values in "cSt".

The content of silicone oil or varnish in the fine powder agglomerate (C) may be 20–90 wt. %, preferably 27–85 wt. %, further preferably 40–80 wt. %, so as to obtain prescribed effects.

In case where the silicone content is below 20 wt. %, the fine powder agglomerate (C) can scarcely show the effect of preventing transfer dropout and toner sticking onto the photosensitive drum. In excess of 90 wt. %, it becomes difficult to retain the silicone oil or varnish in the particles, whereby excessive silicone oil or varnish is liable to agglomerate the toner particles, thereby causing image quality deterioration.

The fine powder agglomerate particles (C) formed from the silicone oil or varnish and the fine powder may preferably be used in a proportion of 0.01–10 wt. parts, more preferably 0.03–5 wt. parts, further preferably 0.05–2 wt. parts, per 100 wt. parts of the toner. Below 0.01 wt. part, the effect of suppressing the transfer dropout and the toner sticking onto the photosensitive drum becomes scarce and, in excess of 10 wt. parts, the fixability of the toner is liable to be impaired.

The fine powder agglomerate (C) composed of silicone oil or varnish and fine powder contains a relatively large proportion, i.e., 20–90 wt. %, of silicone oil or varnish exhibiting good releasability, thus providing an enhanced releasability between the toner and the photosensitive member surface.

As silicone oil is more easily applied onto the photosensitive member surface than silicone varnish, silicone oil is preferred. It is preferred that the silicone oil does not contain an alkoxy group.

The fine powder agglomerate particles (C) may preferably have an average particle size of 0.5–50 $\mu$m so as to provide a good uniform mixability in the toner. The agglomerate particles (C) can be size-reduced during the blending with the toner particles or an excessively large portion thereof can be removed, e.g., by sieving after the blending with the toner particles.

It is further preferred that the toner according to the present invention contains resin particles as external additive particles (D) in order to improve the developing performance and flowability.

The resin particles (D) may be produced by emulsion polymerization or spray drying. The resin particles (D) may preferably be produced as resin particles having a glass transition point (Tg) of at least 80° C. through homopolymerization or copolymerization by emulsion polymerization of monomers, such as styrene, acrylic acid, methyl methacrylate, butyl acrylate and 2-ethylhexyl acrylate; generally used as components for providing a toner binder resin.

The resin particles (D) can have been crosslinked with a crosslinking agent, such as divinylbenzene, and can have been treated with, e.g., a metal, a metal oxide, a pigment or dye, or a surfactant.

It is particularly preferred that the resin particles (D) comprise a block or random styrene copolymer including at least 51 wt. % of polymerized styrenic monomer units. Such styrene-based resin particles have a position in triboelectric chargeability series close to those of styrene-acrylic copolymer resin and polyester resin frequently used as a toner binder resin, so that they have little mutual chargeability with toner particles, thus being less liable to deteriorate the flowability.

The resin particles (D) may preferably have an average particle size of 0.01–1.0 $\mu$m in order to provide a satisfactory level of improvement in developing performance.

The above-mentioned average particle sizes of the inorganic fine powder (B), the fine powder agglomerate particles (C) and the resin particles (D) are based on values measured in the following manner.

Sample particles are photographed through an electron microscope ("S-800", made by Hitachi Seisakusho K. K.) at magnifications of $10^5$–$2\times10^5$ for the inorganic fine powder (B), 100–2000 for the fine powder agglomerate particles (C) and $10^4$–$2\times10^4$ for the resin particles (D). Ca. 100–200 particles (sampling minimum particle sizes are 5 nm for (B), 0.2 $\mu$m for (C) and 0.005 $\mu$m for (D)) were sampled at random from the photographed particles, and the diameters of the respective particles are measured, e.g., by a caliper to obtain a number-average value.

A preferred embodiment of the image forming method according to the present invention will now be described with reference FIG. 2.

The circumferential surface of an OPC photosensitive drum 3 as an electrostatic latent image-bearing member is charged to a negative polarity by a contact charging member 11 comprising a charging roller as a primary charger and exposed to scanning laser light 5 carrying prescribed image data to form a digital electrostatic latent image thereon, which is then subjected to reversal development with a magnetic toner 13 having a negative triboelectric chargeability in a developing device 1 (as a developing means) comprising a developing sleeve 6 equipped with an urethane rubber-made elastic blade 8 disposed in a counter direction and containing a magnet 15 therein, thereby forming a toner image on the photosensitive drum 3 (alternatively, an amorphous silicon photosensitive member may be used to form a positively charged electrostatic latent image, which is subjected to normal development with a negatively charged magnetic toner). The developing sleeve 6 is supplied with an alternating bias voltage, a pulse bias voltage and/or a DC bias voltage is supplied from a bias voltage application means 12. A transfer(-receiving) paper P is conveyed to a transfer position, where the back surface (on the opposite side with respect to the photosensitive drum 3) is charged by a contact charging member 4 comprising a transfer roller as a transfer means to electrostatically transfer the toner image on the photosensitive drum onto the transfer paper P. The transfer paper P thus carrying the toner image is then separated from the photosensitive drum 3 and subjected to a fixing treatment for fixing the toner image onto the transfer paper P by using a hot-pressure fixing device comprising a heating roller 21 equipped with an internal heating means 20 and a pressure roller.

The residual magnetic toner remaining on the photosensitive drum 3 after the transfer step is removed by a cleaning device 14 having a cleaning blade 7. The photosensitive drum 3 after the cleaning is discharged (charge-removed) by illumination of erasure light from an erasing light source 10, and then subjected to a further image forming cycle starting with the charging step by the primary charger The electrostatic latent image-bearing member (photosensitive drum) 3 comprises a photosensitive layer and an electroconductive substrate and rotates in the direction of an indicated arrow. The developing sleeve 6 comprising a hollow non-magnetic cylinder as a developer-carrying member rotates so as to move in the same direction as the photosensitive drum 3 surface at the developing position. Inside the non-magnetic cylinder developing sleeve 6, a multi-pole permanent magnet 15 (magnet roll) as a magnetic field generating means is disposed so as not to rotate. The magnetic toner 13 in the developing device 1 is applied onto the circumferential surface of the non-magnetic developing sleeve 6 and is provided with a negative triboelectric charge due to friction between the developing sleeve 6 surface and the magnetic toner particles. Further, by disposing the elastic doctor blade 8, the developer layer on the developing sleeve 6 is regulated in a uniformly small thickness (of 30–300 $\mu$m), thus forming a thin toner layer which has a thickness smaller than a gap between the photosensitive drum 3 and the developing sleeve 6, thus being substantially in no contact with the photosensitive drum 3, at the developing position. The rotation speed of the sleeve 6 is adjusted to provide a circumferential speed which is substantially identical or close to that of the photosensitive drum 3.

The developing sleeve 6 may be supplied with an alternating bias voltage or a pulse bias voltage from the bias voltage application means 12. The alternating bias voltage may preferably comprise f=200–4000 Hz and Vpp=500–3000 volts.

At the developing position, the magnetic toner particles are transferred onto the electrostatic latent image held on the photosensitive drum under the action of an electrostatic force exerted by the photosensitive drum 3 surface holding the electrostatic image and the alternating or pulse bias voltage.

Among the components of image forming apparatus as described above including the image-bearing member, such as the photosensitive drum, the developing device and the cleaning means, a plurality can be integrated into an apparatus unit, i.e., a process cartridge, which is detachably mountable to a main body of the image forming apparatus. For example, the charging means and the developing means may be integrally supported together with the photosensitive drum to form a process cartridge, as a single apparatus unit detachably mountable to the apparatus main body by using a guide means, such as a rail provided to the main body. In this case, the cleaning means can be further integrated into the process cartridge.

Figure 3:
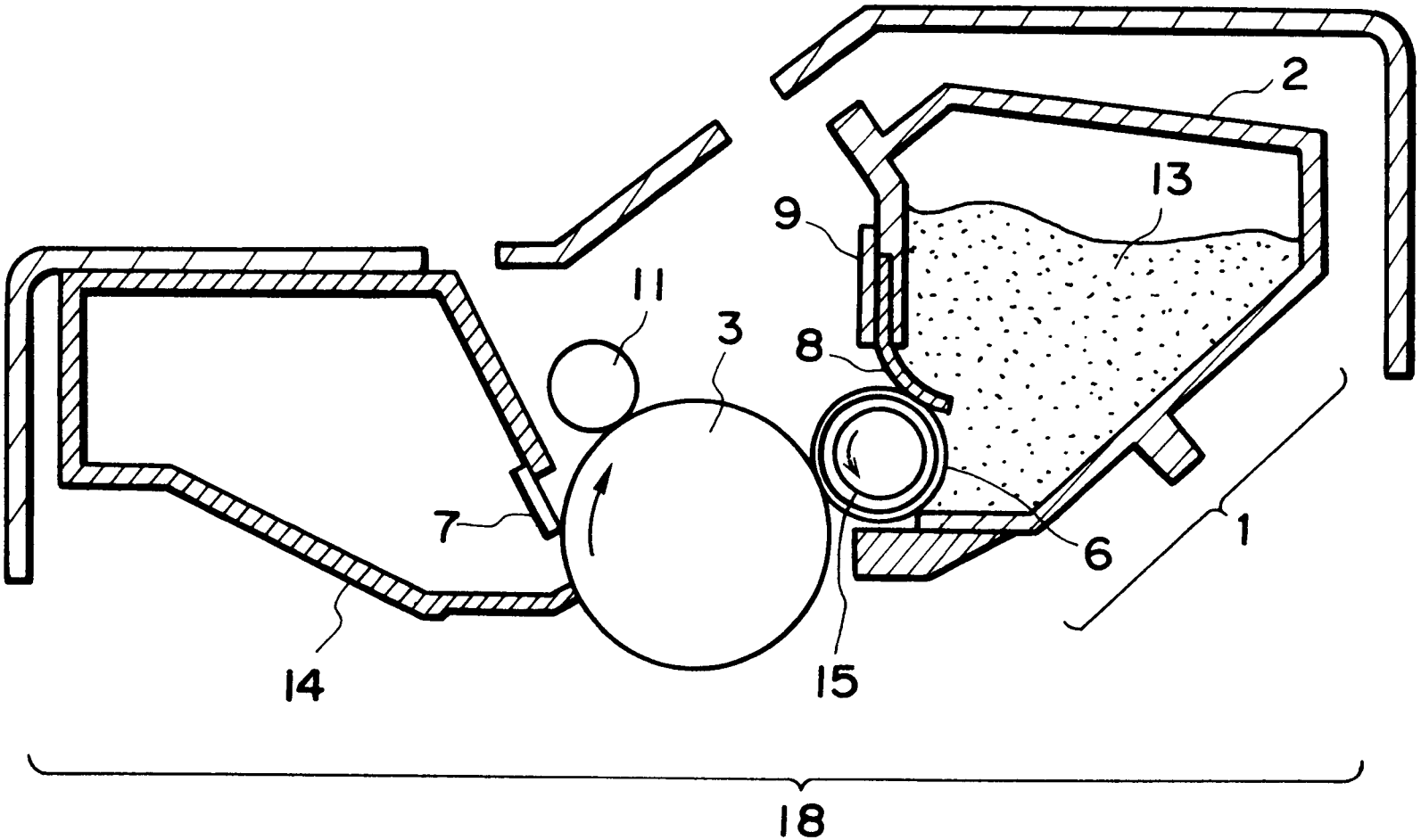
FIG. 3 is an illustration of an embodiment of the process cartridge according to the invention.

FIG. 3 illustrates an embodiment of the process cartridge according to the present invention. In this embodiment, a developing device 1, a photosensitive drum 3, a cleaner 14 and a primary charger 11 are integrated to form a process cartridge 18.

When the magnetic toner 13 in the developing device 1 is used up, the process cartridge is replaced with a fresh process cartridge.

In this embodiment, the developing device 1 contains a magnetic toner 13. The gap between the photosensitive drum 3 and the developing sleeve 6 is very important so that a prescribed electric field is formed between the photosensitive drum 3 and the developing sleeve at the time of development to satisfactorily effect the developing step. In this embodiment, the gap is adjusted to a central value of 300 μm with a tolerance of ±20 μm.

In the process cartridge 18 shown in FIG. 3, the developing device 1 comprises a toner vessel 2 for containing a magnetic toner 13, a developing sleeve 6 for carrying and conveying the magnetic toner 13 in the toner vessel 2 to a developing region facing the photosensitive drum 3, and an elastic blade 8 for regulating the magnetic toner carried on and conveyed to the developing region to a prescribed thickness, thereby forming a thin toner layer on the developing sleeve 6.

The developing sleeve 6 may have a fairly arbitrary structure. Ordinarily, the developing sleeve 6 is composed as a non-magnetic rotatable hollow cylinder (sleeve) 6 containing therein a magnet 15. Alternative, it may be constituted as a circulatively moving half-form toner carrying member. The sleeve may ordinarily comprise aluminum or stainless steel (SUS).

The electric blade 8 may be formed as an elastic plate or sheet comprising: an elastomer, such as urethane rubber, silicone rubber, or nitrile rubber (NBR); an elastic metal, such as phosphor bronze or stainless steel; or elastic resin, such as polyethylene terephthalate or high-density polyethylene. The elastic blade is abutted against the developing sleeve 6 by utilizing its elasticity and is fixed to the toner vessel 2 by means of a blade-support member 8 comprising a rigid material such as iron. The elastic blade 8 may preferably be abutted at a linear pressure of 5–80 g/cm in a counter direction with respect to the rotation direction of the developing sleeve 6.

It is also possible to use a magnetic doctor blade of, e.g., iron, instead of the elastic blade 8.

In the above embodiment, a charging roller 11 as a contact charging means is used, but it is possible to use a contact charging means, such as a charging blade or a charging brush, or to use a non-contact charging means, such as a corona charging means. However, a contact charging means is preferred because of less occurrence of ozone during the charging. The transfer means may also be another contact charging means, such as a charging blade, instead of the transfer charging roller 4 used in the above embodiment, or can also be a non-contactive corona charging means. Also in this case, non-contactive charging means is preferred because of less occurrence of ozone during the transfer.

Figure 2:
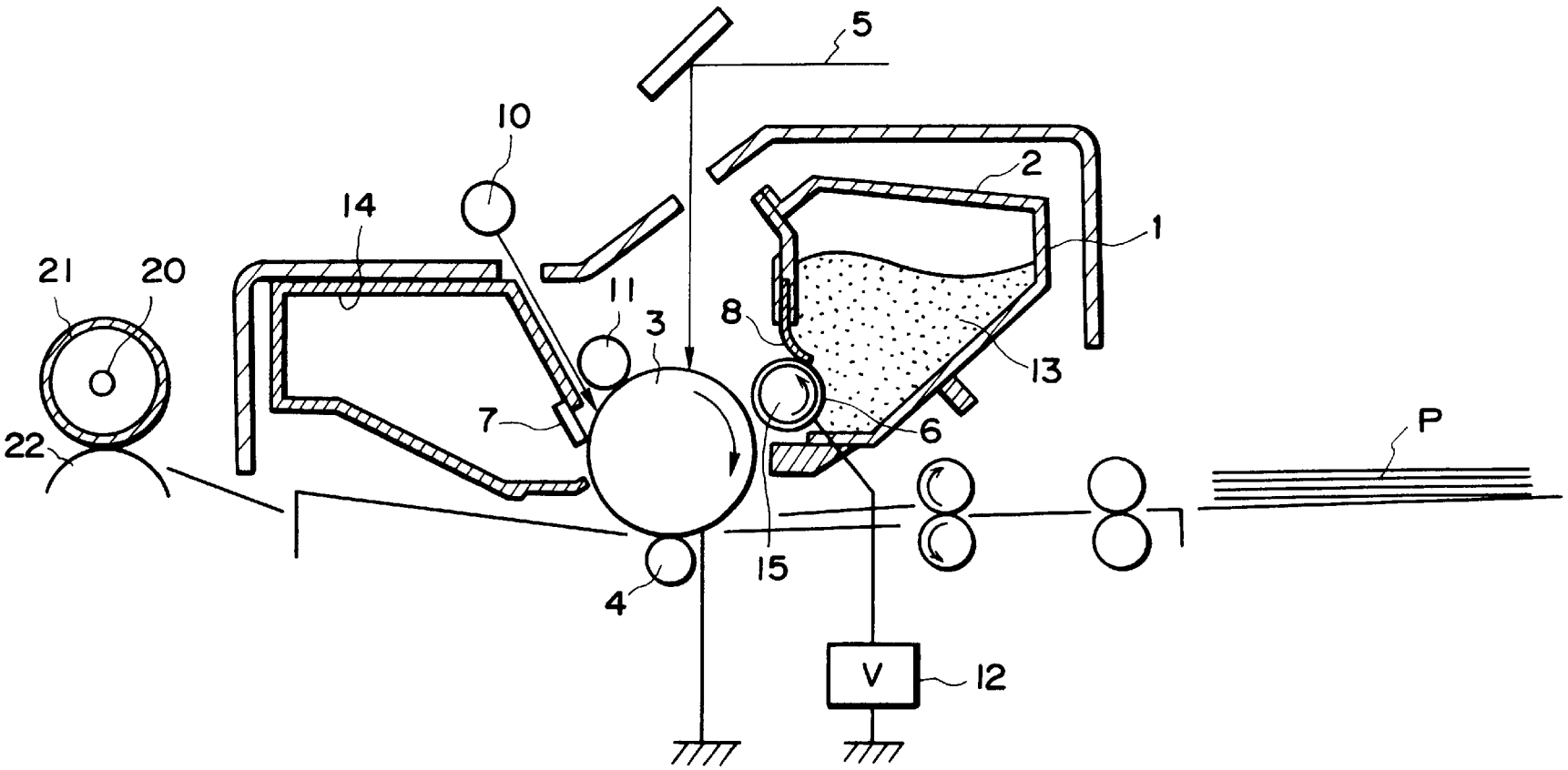
FIG. 2 is a schematic illustration of an image forming apparatus used in an embodiment of the image forming method according to the invention.
Figure 4:
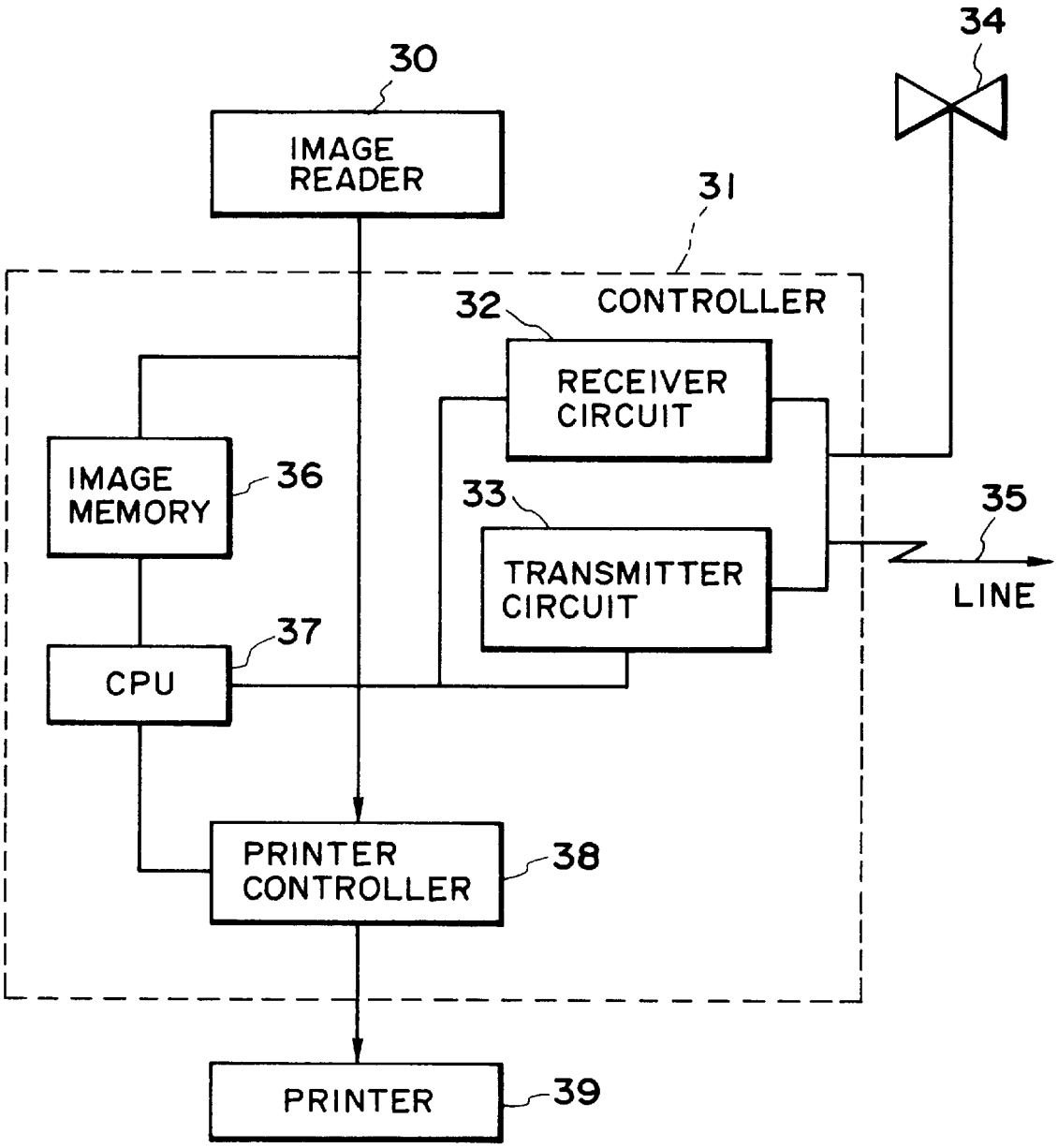
FIG. 4 is a block diagram of a facsimile apparatus including a printer to which the image forming method of the invention is applicable.

In case where the image forming method according to the present invention is applied to a printer for facsimile, the image light L (as shown in FIG. 2) may be replaced by exposure light image for printing received data. FIG. 4 is a block diagram for illustrating such an embodiment.

Referring to FIG. 4, a controller 31 controls an image reader (or image reading unit) 30 and a printer 39. The entirety of the controller 31 is regulated by a CPU 37. Data read from the image reader 30 is transmitted through a transmitter circuit 33 to a remote terminal such as another facsimile machine. On the other hand, data received from a remote terminal is transmitted through a receiver circuit 32 to a printer 39. An image memory 36 stores prescribed image data. A printer controller 38 controls the printer 39. A telephone handset 34 is connected to the receiver circuit 32 and the transmitter circuit 33.

More specifically, an image received from a line (or circuit) 35 (i.e., image data received from a remote terminal connected by the line) is demodulated by means of the receiver circuit 32, decoded by the CPU 37, and sequentially stored in the image memory 36. When image data corresponding to at least one page is stored in the image memory 36, image recording or output is effected with respect to the corresponding page. The CPU 37 reads image data corresponding to one page from the image memory 36, and transmits the decoded data corresponding to one page to the printer controller 38. When the printer controller 38 receives the image data corresponding to one page from the CPU 37, the printer controller 38 controls the printer 39 so that image data recording corresponding to the page is effected. During the recording by the printer 39, the CPU 37 receives another image data corresponding to the next page.

Thus, receiving and recording of an image may be effected by means of the apparatus shown in FIG. 4 in the above-mentioned manner.

As described above, according to the present invention, there is provided a toner capable of providing images with excellent dot reproducibility without causing a lowering in toner charge, a lowering in image density or image quality deterioration even in a long period of continuous image formation in a high temperature/high humidity environment.

Hereinbelow, the present invention will be described more specifically based on Examples, wherein "parts" are by weight.

[Production of external additive particles (A)]

(1) 600 g of strontium titanate and 320 g of titanium oxide were wet-blended for 8 hours in a ball mill, then recovered by filtration and dried. The blend product was pelletized under a pressure of 5 kg/cm$^2$ and calcined for 8 hours at 1100° C.

The resultant strontium titanate was pulverized by a pulverizer using a jet air stream and classified to some extent by a pneumatic classifier, followed by dispersion in water, accurate classification by centrifugation, drying and disintegration, to obtain Strontium titanate particles I (as external additive particles (A)) which exhibited a number-average circle-equivalent diameter of 1.4 μm and a value b−a of −0.51 as a result of the flow particle image analyzer measurement.

(2) Other external additive particles (A) shown in Table 2 appearing hereinafter were prepared in a similar manner as above through pulverization and classification (with or without centrifugation).

EXAMPLE 1

| | |
|---|---|
| Styrene/butyl acrylate/monobutyl maleate copolymer (weight ratio = 75/20/15) | 100 part(s) |
| Magnetic iron oxide particles | 100 part(s) |
| Azo iron complex (1) mentioned before | 1 part(s) |
| Aliphatic alcohol wax (Mw = 700) | 3 part(s) |

After preliminary blending, the above ingredients were melt-kneaded through a twin-screw struder. The melt-kneaded product was cooled, coarsely crushed and finely pulverized by a pulverizer using a jet air stream, followed by two times of classification by an Elbow Jet classifier to obtain toner particles having a weight-average particle size (D4) of 5.91 μm and a volume-average particle size (Dv) of 5.10 μm and containing 14.3% by number of particles of 2.00–3.17 μm ($C_{2.00-3.17\ \mu m}$=14.3 N. %) and 3.1% by number of at least 1.00 μm and below 2.00 μm ($C_{1.00-2.00\ \mu m}$=3.1 N. %).

| | |
|---|---|
| Hydrophobic silica (number-average particle size (D1) = 0.02 μm; additive (B)) | 1.5 part(s) |
| Fine powder agglomerate** (D1 = 10 μm; additive (C)) | 0.1 part(s) |
| Styrene-acrylate copolymer particles (D1 = 0.5 μm, additive (D)) | 0.08 part(s) |
| Strontium titanate particles I (additive (A)) | 0.8 part(s) |

**: 40 parts of wet-process silica fine powder having a BET specific surface area of 110 $m^2/g$ was agglomerated together with 60 parts of dimethylsilicone oil of 12500 cSt.

To 100 parts of the toner particles prepared above, the above external additives (A)–(D) were blended in a Henschel mixer to prepare a toner for developing electrostatic images. The properties of the toner thus obtained are shown in Table 3 appearing hereinafter together with those of toners obtained in Examples and Comparative Examples described below.

EXAMPLE 2

In similar manners as in Example 1, toner particles (D4=5.63 μm, Dv=4.89 μm, $C_{2.00-3.17\ \mu m}$=26.5 N. %. $C_{1.00-2.00\ \mu m}$=4.2 N. %) were prepared, and 100 parts thereof were blended with external additives including 2.0 parts of Titanium oxide I instead of Strontium titanate I to form a toner.

EXAMPLE 3

In similar manners as in Example 1, toner particles (D4=5.78 μm, Dv=4.99 μm, $C_{2.00-3.17\ \mu m}$=14.2 N. %. $C_{1.00-2.00\ \mu m}$=4–4 N. %) were prepared, and 100 parts thereof were blended with external particles including 0.5 part of Zinc stearate I instead of Strontium titanate I to form a toner.

EXAMPLE 4

In similar manners as in Example 1, toner particles (D4=6.45 μm, Dv=5.53 μm, $C_{2.00-3.17\ \mu m}$=5.5 N. %. $C_{1.00-2.00\ \mu m}$=8.9 N. %) were prepared, and 100 parts thereof were blended with external additives including 0.09 part of Acrylic resin particles I instead of Strontium titanate I to form a toner.

EXAMPLE 5

In similar manners as in Example 1, toner particles (D4=5.82 μm, Dv=5.02 μm, $C_{2.00-3.17\ \mu m}$=31.4 N. %. $C_{1.00-2.00\ \mu m}$=7.5 N. %) were prepared, and 100 parts thereof were blended with external particles including 1.0 part of Titanium oxide I instead of 0.8 part of Strontium titanate I to form a toner.

EXAMPLE 6

In similar manners as in Example 1, toner particles (D4=5.10 μm, Dv=4.44 μm, $C_{2.00-3.17\ \mu m}$=20.1 N. %. $C_{1.00-2.00\ \mu m}$=2.0 N. %) were prepared, and 100 parts thereof were blended with external additives including 5.0 parts of Strontium titanate I instead of 0.8 part of Strontium titanate I to form a toner. Example 7 In similar manners as in Example 1, toner particles (D4=5.87 μm, Dv=5.06 μm, $C_{2.00-3.17\ \mu m}$=14.4 N. %. $C_{1.00-2.00\ \mu m}$=0.8 N. %) were prepared, and 100 parts thereof were blended with external additives including 0.1 part of Strontium titanate I instead of 0.8 part of Strontium titanate I to form a toner. Example 8 In similar manners as in Example 1, toner particles (D4=6.38 μm, Dv=5.48 μm, $C_{2.00-3.17\ \mu m}$=12.8 N. %. $C_{1.00-2.00\ \mu m}$=1.1 N. %) were prepared, and 100 parts thereof were blended with external additives including 0.1 part of Strontium titanate I instead of 0.8 part of Strontium titanate I to form a toner.

EXAMPLE 9

In similar manners as in Example 1, toner particles (D4=5.72 μm, Dv=4.96 μm, $C_{2.00-3.17\ \mu m}$=16.9 N. %. $C_{1.00-2.00\ \mu m}$=8.2 N. %) were prepared, and 100 parts thereof were blended with external additives including 1.0 part of Strontium titanate II instead of Strontium titanate I to form a toner.

EXAMPLE 10

In similar manners as in Example 1, toner particles (D4=5.90 μm, Dv=5.08 μm, $C_{2.00-3.17\ \mu m}$=15.0 N. %. $C_{1.00-2.00\ \mu m}$=2.9 N. %) were prepared, and 100 parts thereof were blended with external additives including 1.0 part of Strontium titanate III instead of Strontium titanate I to form a toner.

EXAMPLE 11

In similar manners as in Example 1, toner particles (D4=5.86 μm, Dv=5.03 Pm, $C_{2.00-3.17\ \mu m}$=22.7 N. %. $C_{1.00-2.00\ \mu m}$=12.0 N. %) were prepared except for effecting only one time of classification by an Elbow Jet classifier, and 100 parts thereof were blended with external additives including similarly 0.8 part of Strontium titanate I to form a toner.

EXAMPLE 12

In similar manner as in Example 1, toner particles (D4=6.15 μm, Dv=5.28 μm, $C_{2.00-3.17\ \mu m}$=10.7 N. %, $C_{1.00-2.00\ \mu m}$=5.1 N. %) were prepared except for changing the classification conditions, and 100 parts thereof were blended with external additives to form a toner having properties as shown in Table 3.

The number-basis circle-equivalent diameter distributions of the toner after and before the addition of external additives are shown in Tables 5 and 6, respectively, and also as graphs shown in FIGS. 1A and 1B, respectively. In FIGS. 1A and 1B, frequency distributions were originally provided as histograms while they are not seen as such in FIGS. 1A and 1B due to a limitation of drawing.

COMPARATIVE EXAMPLE 1

In similar manners as in Example 1, toner particles (D4=7.52 μm, Dv=6.40 μm, $C_{2.00-3.17\ \mu m}$=7.9 N. %. $C_{1.00-2.00\ \mu m}$=0.4 N. %) were prepared, and 100 parts thereof were blended with external additives including 1.0 part of Comparative titanate oxide instead of Strontium titanate I to form a toner.

COMPARATIVE EXAMPLE 2

In similar manners as in Example 1, toner particles (D4=11.32 μm, Dv=9.49 μm, $C_{2.00-3.17\ \mu m}$=0.2 N. %. $C_{1.00-2.00\ \mu m}$=1.2 N. %) were prepared, and 100 parts thereof were blended with external additives including no Strontium titanate I to form a toner.

COMPARATIVE EXAMPLE 3

In similar manners as in Example 1, toner particles (D4=5.71 μm, Dv=4.93 μm, $C_{2.00-3.17\ \mu m}$15.4 N. %. $C_{1.00-2.00\ \mu m}$=1.8 N. %) were prepared, and 100 parts thereof were blended with external additives including 1.0 part of Comparative dry-process silica instead of Strontium titanate I to form a toner.

COMPARATIVE EXAMPLE 4

In similar manners as in Example 1, toner particles (D4=5.85 μm, Dv=5.02 μm, $C_{2.00-3.17\,\mu m}$=15.1 N. %. $C_{1.00-2.00\,\mu m}$=4.3 N. %) were prepared, and 100 parts thereof were blended with external additives including 1.0 part of Comparative strontium titanate instead of Strontium titanate I to form a toner.

<Toner performance evaluation>

Each of the toners prepared in the above-described Examples and Comparative Examples was evaluated in the following manner.

A commercially available laser beam printer ("LBP-450", made by Canon K. K.) having a structure substantially as illustrated in FIG. 2 was remodeled so as to provide a printing speed of 20 A4-size sheets/min. instead of the original speed of 12 A4-size sheets/min., and then subjected to a continuous image forming test while reprenishing a fresh toner as desired through a cut provided at an upper part of the toner vessel on $3\times10^4$ sheets in each of a low temperature/low humidity (10° C./15%RH) environment and a high temperature/high humidity (32.5° C./90%RH) environment. The resultant images were evaluated with respect to the following items.

(1) Dot reproducibility

Discrete single dot images were printed out at the initial stage and after formation on $3\times10^4$ sheets, respectively, during the continuous image formation in the high temperature/high humidity environment and evaluated by observation through a microscope according to the following standard.

A: Very good (Discrete single dots were reproduced faithfully with almost no toner scattering).

B: Good (Discrete single dots were reproduced faithfully).

C: Fair (Single dot images were slightly soiled).

D: Poor (Single dot images were disordered noticeably and exhibited a poor reproducibility).

(2) Image density

Image densities (relative to that of a white ground portion having a density of 0.00) were measured with respect to printed-out images formed at the initial stage and after $3\times10^4$ sheets, respectively, in the continuous image formation in the high temperature/high humidity environment, and printed-out images formed after $3\times10^4$ sheets in the low temperature/low humidity environment, respectively, on plain paper (75 g/m2) for copying by using a reflectodensitometer (available from Macbeth Co.).

(3) Fog

The whiteness of a solid white image formed after printing-out on $3\times10^4$ sheets in the low temperature/low humidity environment was measured relative to the whiteness of white plain paper before printing by using a reflectometer (available from Tokyo Denshoku K. K.).

The results of evaluation on the above items (1)–(3) are inclusively shown in Table 4.

TABLE 2

| External additives (A) | Average circle-equivalent dia. (μm) | b-a*2 |
|---|---|---|
| Strontium titanate I | 1.4 | −0.51 |
| Strontium titanate II | 2.5 | 0.33 |
| Strontium titanate III | 3.1 | 0.14 |
| Titanium oxide I | 1.1 | 0.26 |
| Zinc stearate I | 1.8 | −0.39 |
| Acrylic resin particles | 1.2 | −0.22 |
| Comparative strontium*1 titanate | 3.7 | 0.43 |
| Comparative titanium*1 oxide | 0.1 | 0.36 |
| Comparative silica*1 | 3.2 | 0.59 |

*1obtained through no centrifugation

*2a = $C_{1.00-1.03\,\mu m}$ (% by number)

b = $C_{2.00-2.06\,\mu m}$ (% by number)

TABLE 3

| | Toner properties | | | | | | |
|---|---|---|---|---|---|---|---|
| | Coulter counter | | | Flow particle image analyzer | | | |
| Ex. or Comp. Ex. | X (= D4) (μm) | Y*1 (N. %) | Dv (μm) | $C_{1.00-2.00\mu m}$*2 (N. %) | B—A*4 | $C_{1.00-2.00\mu m}$*3 (N. %) | Tap void |
| Ex. | | | | | | | |
| 1 | 5.91 | 14.3 | 5.10 | 3.1 | −0.48 | 16.1 | 0.52 |
| 2 | 5.63 | 26.5 | 4.87 | 4.2 | 0.24 | 37.7 | 0.61 |
| 3 | 5.78 | 14.2 | 4.99 | 4.4 | −0.21 | 18.8 | 0.47 |
| 4 | 6.45 | 5.5 | 5.53 | 8.9 | −0.47 | 27.4 | 0.66 |
| 5 | 5.82 | 31.4 | 5.02 | 7.5 | 0.28 | 18.3 | 0.57 |
| 6 | 5.10 | 20.1 | 4.44 | 2.0 | −0.63 | 22.0 | 0.41 |
| 7 | 5.87 | 14.4 | 5.06 | 0.8 | −0.52 | 7.9 | 0.58 |
| 8 | 6.38 | 12.8 | 5.48 | 1.1 | −0.39 | 9.2 | 0.60 |
| 9 | 5.72 | 16.9 | 4.96 | 8.2 | 0.21 | 23.4 | 0.60 |
| 10 | 5.90 | 15.0 | 5.08 | 2.9 | 0.16 | 14.1 | 0.51 |
| 11 | 5.86 | 22.7 | 5.03 | 12.0 | −0.10 | 28.3 | 0.53 |
| 12 | 6.15 | 10.7 | 5.28 | 5.1 | −0.57 | 16.1 | 0.54 |

TABLE 3-continued

| Ex. or Comp. Ex. | Toner properties: Coulter counter: X (= D4) (μm) | Y*1 (N. %) | Dv (μm) | Flow particle image analyzer: $C_{1.00-2.00\mu m}$*2 (N. %) | B—A*4 | $C_{1.00-2.00\mu m}$*3 (N. %) | Tap void |
|---|---|---|---|---|---|---|---|
| Comp. Ex. | | | | | | | |
| 1 | 7.52 | 7.9 | 6.40 | 0.4 | 0.37 | 2.2 | 0.31 |
| 2 | 11.30 | 0.2 | 9.49 | 1.2 | 0.07 | 1.4 | 0.27 |
| 3 | 5.71 | 15.4 | 4.93 | 1.8 | 0.40 | 3.7 | 0.59 |
| 4 | 5.85 | 15.1 | 5.02 | 4.3 | 0.47 | 7.2 | 0.48 |

*1Content (% by number) of particles of 2.00–3.17 μm.
*2Content (% by number) of particles having circle-equivalent diameters of 1.00–2.00 μm in toner particles after classification.
*3Content (% by number) of particles having circle-equivalent diameters of 1.00–2.00 μm in the toner after addition of the external additive.
*4$C_{2.00-2.06\mu m}$ (B % by number) − $C_{1.00-1.03\mu m}$ (A % by number) based on circle-equivalent diameters.

TABLE 4

| | Toner performances: 32.5° C./90% RH: Initial (1) Dot | Initial (2) I.D. | After 3 × 10^4 (1) Dot | After 3 × 10^4 (2) I.D. | 10° C./15% RH: After 3 × 10^4 sheets (2) I.D. | (3) Fog |
|---|---|---|---|---|---|---|
| Ex. 1 | A | 1.48 | A | 1.48 | 1.51 | 0.7 |
| Ex. 2 | A | 1.47 | A | 1.48 | 1.49 | 0.9 |
| Ex. 3 | A | 1.48 | A | 1.46 | 1.43 | 2.5 |
| Ex. 4 | B | 1.47 | B | 1.45 | 1.48 | 1.0 |
| Ex. 5 | A | 1.45 | A | 1.43 | 1.29 | 3.5 |
| Ex. 6 | A | 1.41 | A | 1.38 | 1.31 | 4.1 |
| Ex. 7 | A | 1.44 | C | 1.27 | 1.48 | 1.2 |
| Ex. 8 | C | 1.40 | C | 1.28 | 1.46 | 1.5 |
| Ex. 9 | A | 1.43 | C | 1.35 | 1.42 | 0.8 |
| Ex. 10 | A | 1.39 | C | 1.30 | 1.40 | 1.9 |
| Ex. 11 | A | 1.40 | C | 1.28 | 1.33 | 2.1 |
| Ex. 12 | A | 1.48 | A | 1.48 | 1.50 | 0.5 |
| Comp. Ex. 1 | D | 1.31 | D | 1.13 | 1.44 | 1.3 |
| Comp. Ex. 2 | D | 1.38 | D | 1.02 | 1.32 | 2.0 |
| Comp. Ex. 3 | A | 1.41 | D | 1.18 | 1.29 | 3.7 |
| Comp. Ex. 4 | A | 1.35 | D | 1.05 | 1.37 | 4.2 |

TABLE 5

Circle-equivalent diameter (C.E.D.) distribution of a toner after extend additive addition

| C.E.D. range (μm) | % by number: cumulative | frequency |
|---|---|---|
| 0.60–0.61 | 0 | 0 |
| 0.61–0.63 | 0 | 0 |
| 0.63–0.65 | 0.09 | 0.09 |
| 0.65–0.67 | 0.34 | 0.25 |
| 0.67–0.69 | 0.75 | 0.41 |
| 0.69–0.71 | 1.33 | 0.58 |
| 0.71–0.73 | 2.05 | 0.71 |
| 0.73–0.75 | 2.86 | 0.81 |
| 0.75–0.77 | 3.77 | 0.92 |
| 0.77–0.80 | 4.87 | 1.09 |
| 0.80–0.82 | 6.08 | 1.22 |

TABLE 5-continued

Circle-equivalent diameter (C.E.D.) distribution of a toner after extend additive addition

| C.E.D. range (μm) | % by number: cumulative | frequency |
|---|---|---|
| 0.82–0.84 | 7.28 | 1.2 |
| 0.84–0.87 | 8.47 | 1.19 |
| 0.87–0.89 | 9.62 | 1.15 |
| 0.89–0.92 | 10.72 | 1.11 |
| 0.92–0.95 | 11.82 | 1.1 |
| 0.95–0.97 | 12.94 | 1.12 |
| 0.97–1.00 | 13.99 | 1.05 |
| 1.00–1.03 | 14.91 | 0.92 |
| 1.03–1.06 | 15.76 | 0.85 |
| 1.06–1.09 | 16.55 | 0.79 |
| 1.09–1.12 | 17.34 | 0.78 |
| 1.12–1.16 | 18.14 | 0.81 |
| 1.16–1.19 | 18.97 | 0.83 |
| 1.19–1.23 | 19.76 | 0.79 |
| 1.23–1.26 | 20.51 | 0.75 |
| 1.26–1.30 | 21.26 | 0.75 |
| 1.30–1.34 | 22 | 0.74 |
| 1.34–1.38 | 22.69 | 0.69 |
| 1.38–1.42 | 23.35 | 0.65 |
| 1.42–1.46 | 23.97 | 0.62 |
| 1.46–1.50 | 24.57 | 0.6 |
| 1.50–1.55 | 25.17 | 0.6 |
| 1.55–1.59 | 25.77 | 0.61 |
| 1.59–1.64 | 26.37 | 0.6 |
| 1.64–1.69 | 27.05 | 0.68 |
| 1.69–1.73 | 27.72 | 0.66 |
| 1.73–1.79 | 28.33 | 0.61 |
| 1.79–1.84 | 28.86 | 0.53 |
| 1.84–1.89 | 29.3 | 0.44 |
| 1.89–1.95 | 29.69 | 0.39 |
| 1.95–2.00 | 30.05 | 0.36 |
| 2.00–2.06 | 30.4 | 0.35 |
| 2.06–2.12 | 30.76 | 0.35 |
| 2.12–2.18 | 31.12 | 0.36 |
| 2.18–2.25 | 31.48 | 0.36 |
| 2.25–2.31 | 31.83 | 0.35 |
| 2.31–2.38 | 32.18 | 0.35 |
| 2.38–2.45 | 32.55 | 0.36 |
| 2.45–2.52 | 32.92 | 0.37 |
| 2.52–2.60 | 33.29 | 0.37 |
| 2.60–2.67 | 33.63 | 0.34 |
| 2.67–2.75 | 33.95 | 0.32 |
| 2.75–2.83 | 34.25 | 0.3 |
| 2.83–2.91 | 34.53 | 0.29 |
| 2.91–3.00 | 34.83 | 0.3 |
| 3.00–3.09 | 35.16 | 0.33 |

TABLE 5-continued

| Circle-equivalent diameter (C.E.D.) distribution of a toner after extend additive addition | | |
|---|---|---|
| | % by number | |
| C.E.D. range (μm) | cumulative | frequency |
| 3.09–3.18 | 35.5 | 0.35 |
| 3.18–3.27 | 35.97 | 0.47 |
| 3.27–3.37 | 36.56 | 0.59 |
| 3.37–3.46 | 37.2 | 0.64 |
| 3.46–3.57 | 37.82 | 0.62 |
| 3.57–3.67 | 38.47 | 0.65 |
| 3.67–3.78 | 39.24 | 0.77 |
| 3.78–3.89 | 40.1 | 0.86 |
| 3.89–4.00 | 41.05 | 0.94 |
| 4.00–4.12 | 42.11 | 1.06 |
| 4.12–4.24 | 43.24 | 1.13 |
| 4.24–4.36 | 44.54 | 1.3 |
| 4.36–4.49 | 46.17 | 1.63 |
| 4.49–4.62 | 48.01 | 1.84 |
| 4.62–4.76 | 49.86 | 1.85 |
| 4.76–4.90 | 51.76 | 1.89 |
| 4.90–5.04 | 53.73 | 1.97 |
| 5.04–5.19 | 55.77 | 2.04 |
| 5.19–5.34 | 58.21 | 2.44 |
| 5.34–5.49 | 61.02 | 2.81 |
| 5.49–5.65 | 63.77 | 2.75 |
| 5.65–5.82 | 66.53 | 2.76 |
| 5.82–5.99 | 69.34 | 2.81 |
| 5.99–6.16 | 72.13 | 2.78 |
| 6.16–6.34 | 75 | 2.87 |
| 6.34–6.53 | 77.85 | 2.85 |
| 6.53–6.72 | 80.42 | 2.56 |
| 6.72–6.92 | 82.83 | 2.42 |
| 6.92–7.12 | 85.25 | 2.42 |
| 7.12–7.33 | 87.61 | 2.36 |
| 7.33–7.54 | 89.85 | 2.24 |
| 7.54–7.76 | 91.8 | 1.95 |
| 7.76–7.99 | 93.42 | 1.62 |
| 7.99–8.22 | 94.81 | 1.4 |
| 8.22–8.46 | 96 | 1.19 |
| 8.46–8.71 | 97 | 1 |
| 8.71–8.96 | 97.78 | 0.77 |
| 8.96–9.22 | 98.3 | 0.52 |
| 9.22–9.49 | 98.67 | 0.37 |
| 9.49–9.77 | 98.99 | 0.31 |
| 9.77–10.05 | 99.24 | 0.25 |
| 10.05–10.35 | 99.44 | 0.21 |
| 10.35–10.66 | 99.63 | 0.18 |
| 10.66–10.96 | 99.75 | 0.13 |
| 10.96–11.28 | 99.85 | 0.09 |
| 11.28–11.61 | 99.92 | 0.07 |
| 11.61–11.95 | 99.97 | 0.04 |
| 11.95–12.30 | 99.99 | 0.02 |
| 12.30–12.66 | 100 | 0.01 |
| 12.66–13.03 | 100 | 0 |

TABLE 6

| Circle-equivalent diameter (C.E.D.) distribution of a toner after extend additive addition | | |
|---|---|---|
| | % by number | |
| C.E.D. range (μm) | cumulative | frequency |
| 0.60–0.61 | 0 | 0 |
| 0.61–0.63 | 0 | 0 |
| 0.63–0.65 | 0.03 | 0.03 |
| 0.65–0.67 | 0.12 | 0.09 |
| 0.67–0.69 | 0.28 | 0.15 |
| 0.69–0.71 | 0.49 | 0.21 |
| 0.71–0.73 | 0.75 | 0.25 |
| 0.73–0.75 | 1.02 | 0.27 |
| 0.75–0.77 | 1.3 | 0.29 |

TABLE 6-continued

| Circle-equivalent diameter (C.E.D.) distribution of a toner after extend additive addition | | |
|---|---|---|
| | % by number | |
| C.E.D. range (μm) | cumulative | frequency |
| 0.77–0.80 | 1.62 | 0.32 |
| 0.80–0.82 | 1.92 | 0.3 |
| 0.82–0.84 | 2.18 | 0.25 |
| 0.84–0.87 | 2.38 | 0.2 |
| 0.87–0.89 | 2.55 | 0.16 |
| 0.89–0.92 | 2.7 | 0.15 |
| 0.92–0.95 | 2.86 | 0.16 |
| 0.95–0.97 | 3.05 | 0.19 |
| 0.97–1.00 | 3.26 | 0.21 |
| 1.00–1.03 | 3.47 | 0.21 |
| 1.03–1.06 | 3.7 | 0.23 |
| 1.06–1.09 | 3.95 | 0.24 |
| 1.09–1.12 | 4.19 | 0.24 |
| 1.12–1.16 | 4.43 | 0.24 |
| 1.16–1.19 | 4.66 | 0.23 |
| 1.19–1.23 | 4.87 | 0.21 |
| 1.23–1.26 | 5.05 | 0.18 |
| 1.26–1.30 | 5.22 | 0.17 |
| 1.30–1.34 | 5.38 | 0.17 |
| 1.34–1.38 | 5.55 | 0.17 |
| 1.38–1.42 | 5.74 | 0.19 |
| 1.42–1.46 | 5.95 | 0.21 |
| 1.46–1.50 | 6.17 | 0.23 |
| 1.50–1.55 | 6.42 | 0.24 |
| 1.55–1.59 | 6.68 | 0.26 |
| 1.59–1.64 | 6.94 | 0.26 |
| 1.64–1.69 | 7.25 | 0.32 |
| 1.69–1.73 | 7.54 | 0.28 |
| 1.73–1.79 | 7.77 | 0.24 |
| 1.79–1.84 | 7.96 | 0.19 |
| 1.84–1.89 | 8.11 | 0.15 |
| 1.89–1.95 | 8.24 | 0.13 |
| 1.95–2.00 | 8.36 | 0.12 |
| 2.00–2.06 | 8.48 | 0.12 |
| 2.06–2.12 | 8.61 | 0.13 |
| 2.12–2.18 | 8.75 | 0.14 |
| 2.18–2.25 | 8.9 | 0.15 |
| 2.25–2.31 | 9.05 | 0.15 |
| 2.31–2.38 | 9.21 | 0.16 |
| 2.38–2.45 | 9.37 | 0.16 |
| 2.45–2.52 | 9.53 | 0.16 |
| 2.52–2.60 | 9.73 | 0.19 |
| 2.60–2.67 | 9.95 | 0.22 |
| 2.67–2.75 | 10.21 | 0.27 |
| 2.75–2.83 | 10.53 | 0.32 |
| 2.83–2.91 | 10.9 | 0.37 |
| 2.91–3.00 | 11.32 | 0.42 |
| 3.00–3.09 | 11.8 | 0.48 |
| 3.09–3.18 | 12.34 | 0.54 |
| 3.18–3.27 | 12.93 | 0.59 |
| 3.27–3.37 | 13.6 | 0.67 |
| 3.37–3.46 | 14.32 | 0.72 |
| 3.46–3.57 | 15.08 | 0.76 |
| 3.57–3.67 | 15.97 | 0.89 |
| 3.67–3.78 | 17.02 | 1.05 |
| 3.78–3.89 | 18.17 | 1.16 |
| 3.89–4.00 | 19.51 | 1.33 |
| 4.00–4.12 | 21.13 | 1.62 |
| 4.12–4.24 | 22.89 | 1.76 |
| 4.24–4.36 | 24.85 | 1.96 |
| 4.36–4.49 | 27.19 | 2.34 |
| 4.49–4.62 | 29.7 | 2.51 |
| 4.62–4.76 | 32.21 | 2.51 |
| 4.76–4.90 | 34.76 | 2.55 |
| 4.90–5.04 | 37.39 | 2.63 |
| 5.04–5.19 | 40.16 | 2.77 |
| 5.19–5.34 | 43.35 | 3.19 |
| 5.34–5.49 | 46.85 | 3.5 |
| 5.49–5.65 | 50.22 | 3.37 |
| 5.65–5.82 | 53.54 | 3.31 |
| 5.82–5.99 | 56.96 | 3.42 |
| 5.99–6.16 | 60.55 | 3.6 |

TABLE 6-continued

| Circle-equivalent diameter (C.E.D.) distribution of a toner after extend additive addition | | |
|---|---|---|
| | % by number | |
| C.E.D. range (μm) | cumulative | frequency |
| 6.16–6.34 | 64.34 | 3.79 |
| 6.34–6.53 | 68.05 | 3.71 |
| 6.53–6.72 | 71.41 | 3.36 |
| 6.72–6.92 | 74.61 | 3.2 |
| 6.92–7.12 | 77.7 | 3.09 |
| 7.12–7.33 | 80.65 | 2.95 |
| 7.33–7.54 | 83.58 | 2.94 |
| 7.54–7.76 | 86.21 | 2.63 |
| 7.76–7.99 | 88.47 | 2.26 |
| 7.99–8.22 | 90.53 | 2.05 |
| 8.22–8.46 | 92.31 | 1.78 |
| 8.46–8.71 | 93.86 | 1.55 |
| 8.71–8.96 | 95.22 | 1.37 |
| 8.96–9.22 | 96.4 | 1.18 |
| 9.22–9.49 | 97.33 | 0.93 |
| 9.49–9.77 | 97.98 | 0.65 |
| 9.77–10.05 | 98.44 | 0.46 |
| 10.05–10.35 | 98.75 | 0.31 |
| 10.35–10.66 | 98.98 | 0.23 |
| 10.66–10.96 | 99.18 | 0.19 |
| 10.96–11.28 | 99.34 | 0.16 |
| 11.28–11.61 | 99.45 | 0.11 |
| 11.61–11.95 | 99.51 | 0.06 |
| 11.95–12.30 | 99.55 | 0.04 |
| 12.30–12.66 | 99.59 | 0.04 |
| 12.66–13.03 | 99.62 | 0.03 |
| 13.03–13.41 | 99.64 | 0.03 |
| 13.41–13.80 | 99.68 | 0.04 |
| 13.80–14.20 | 99.72 | 0.04 |
| 14.20–14.62 | 99.76 | 0.04 |
| 14.62–15.04 | 99.8 | 0.04 |
| 15.04–15.48 | 99.84 | 0.03 |
| 15.48–15.93 | 99.87 | 0.03 |
| 15.93–16.40 | 99.91 | 0.04 |
| 16.40–16.88 | 99.94 | 0.03 |
| 16.88–17.37 | 99.95 | 0.01 |
| 17.37–17.88 | 99.95 | 0.01 |
| 17.88–18.40 | 99.95 | 0 |
| 18.40–18.94 | 99.96 | 0.01 |
| 18.94–19.49 | 99.97 | 0.01 |
| 19.49–20.06 | 99.98 | 0.01 |
| 20.06–20.65 | 99.99 | 0.01 |
| 20.65–21.25 | 100 | 0.01 |
| 21.25–21.87 | 100 | 0 |

What is claimed is:

1. A toner for developing electrostatic images, comprising: toner particles comprising a binder resin and a colorant, and external additive particles;

wherein the toner satisfies the particle size distribution conditions (i) and (ii) below, (i) a particle size distribution based on volume-basis and number-basis particle size distribution of particles having sizes in a range of 2.00–40.30 μm as measured by a Coulter counter, including a weight-average particle size D4 of X μm and Y % by number of particles having sizes of 2.00–3.17 μm satisfying the following conditions (1) and (2):

$$-5X+35 \leqq Y \leqq -25X+180 \quad (1)$$

$$3.5 \leqq X \leqq 6.5 \quad (2), \text{ and}$$

(ii) a particle size distribution of particles having circle-equivalent diameters in a range of 0.60 μm–159.21 μm as measured by a flow particle image analyzer, including A % by number of particles having circle-equivalent diameters of at least 1.00 μm and below 1.03 μm and B % by number of particles having circle-equivalent diameters of at least 2.00 μm and below 2.06 μm satisfying the following condition (3):

$$B-A \leqq 0.30 \quad (3).$$

2. The toner according to claim 1, wherein the parameters A and B satisfying the following condition (4):

$$-0.63 \leqq B-A \leqq 0.30 \quad (4).$$

3. The toner according to claim 1, wherein the parameters X and Y satisfy the following conditions (5) and (6):

$$-5X+35 \leqq Y \leqq -12.5X+98.75 \quad (1)$$

$$4.0 \leqq X \leqq 6.3 \quad (6).$$

4. The toner according to claim 1, wherein the toner contains at least 10% by number of particles having circle-equivalent diameters of at least 1.00 μm and below 2.00 μm.

5. The toner according to claim 1, wherein the toner contains 10–37.7% by number of particles having circle-equivalent diameters of at least 1.00 μm and below 2.00 μm.

6. The toner according to claim 1, wherein the external additive particles include external additive particles (A) having a number-average circle-equivalent diameter of 0.60–4.00 μm as measured by the flow particle image analyzer.

7. The toner according to claim 1, wherein the external additive particles include external additive particles (A) having a number-average circle-equivalent diameter of 1.00–4.00 μm as measured by the flow particle image analyzer.

8. The toner according to claim 1, wherein the external additive particles include external additive particles (A) having a number-average circle-equivalent diameter of 1.00–3.00 μm as measured by the flow particle image analyzer.

9. The toner according to claim 1, wherein the toner particles contain less than 10% by number of particles having circle-equivalent diameters of at least 1.00 μm and below 2.00 μm according to the flow particle image analyzer measurement; and the external additive particles include external additive particles (A) having a number-average circle-equivalent diameter of 0.60–4.00 μm according to the flow particle image analyzer measurement.

10. The toner according to claim 1, wherein the toner particles contain less than 10% by number of particles having circle-equivalent diameters of at least 1.00 μm and below 2.00 μm according to the flow particle image analyzer measurement; and the external additive particles include external additive particles (A) having a number-average circle-equivalent diameter of 1.00–4.00 μm according to the flow particle image analyzer measurement.

11. The toner according to claim 1, wherein the toner particles contain less than 10% by number of particles having circle-equivalent diameters of at least 1.00 μm and below 2.00 μm according to the flow particle image analyzer measurement; and the external additive particles include external additive particles (A) having a number-average circle-equivalent diameter of 1.00–3.00 μm according to the flow particle image analyzer measurement.

12. The toner according to claim 6, wherein the external additive particles (A) contain a % by number of particles having circle-equivalent diameters of at least 1.00 μm and below 1.03 μm and b % number of particles having circle-equivalent diameters of at least 2.00 μm and below 2.06 μm, satisfying the following condition (7):

$$b-a \leqq 0.3 \quad (7).$$

13. The toner according to claim 6, wherein the external additive particles (A) contain a % by number of particles having circle-equivalent diameters of at least 1.00 μm and below 1.03 μm and b % number of particles having circle-equivalent diameters of at least 2.00 μm and below 2.06 μm, satisfying the following condition (8):

$$-0.63 \leqq b-a \leqq 0.3 \quad (8).$$

14. The toner according to claim 6, wherein the external additive particles (A) contain a % by number of particles having circle-equivalent diameters of at least 1.00 μm and below 1.03 μm and b % number of particles having circle-equivalent diameters of at least 2.00 μm and below 2.06 μm, satisfying the following condition (9):

$$-0.51 \leqq b-a \leqq 0.3 \quad (9).$$

15. The toner according to claim 1, wherein the toner particles have been subjected to pre-classification so as to have a reduced content of less than 10% by number of particles having circle-equivalent diameters of at least 1.00 μm and below 2.00 μm according to the flow particle image analyzer measurement prior to being blended with the external additive particles for toner preparation.

16. The toner according to claim 1, wherein the external additive particles include external additive particles (A) which have been subjected a wet-classification by sedimentation for particle size distribution adjustment so as to have a particle size distribution according to the flow particle image analyzer measurement, including a % by number of particles having circle-equivalent diameters of at least 1.00 μm and below 1.03 μm and b % number of particles having circle-equivalent diameters of at least 2.00 μm and below 2.06 μm, satisfying the following condition (7):

$$b-a \leqq 0.3 \quad (7).$$

17. The toner according to claim 1, wherein the external additive particles include external additive particles (A) which have been subjected a wet-classification by sedimentation for particle size distribution adjustment so as to have a particle size distribution according to the flow particle image analyzer measurement, including a % by number of particles having circle-equivalent diameters of at least 1.00 μm and below 1.03 μm and b % number of particles having circle-equivalent diameters of at least 2.00 μm and below 2.06 μm, satisfying the following condition (8):

$$-0.63b-a \leqq 0.3 \quad (8).$$

18. The toner according to claim 1, wherein the external additive particles include external additive particles (A) which have been subjected a wet-classification by sedimentation for particle size distribution adjustment so as to have a particle size distribution according to the flow particle image analyzer measurement, including a % by number of particles having circle-equivalent diameters of at least 1.00 μm and below 1.03 μm and b % number of particles having circle-equivalent diameters of at least 2.00 μm and below 2.06 μm, satisfying the following condition (9):

$$-0.51 \leqq b-a \leqq 0.3 \quad (9).$$

19. The toner according to claim 6, wherein the external additive particles (A) comprise at least one species of particles selected from the group consisting of metal oxide particles, complex metal oxide particles, metal salt particles, clay mineral particles, phosphate compound particles, silicon compound particles, carbon compound particles, resin particles, complex particles of organic compound and inorganic compound, aliphatic acid derivative particles, and lubricant particles.

20. The toner according to claim 6, wherein the external additive particles (A) comprise particles of at least one species of compound selected from the group consisting of zinc oxide, aluminum oxide, titanium oxide, zirconium oxide, manganese oxide, strontium titanate, magnesium titanate, and barium titanate.

21. The toner according to claim 1, wherein the toner has a tap void as defined by the following formula of 0.45–0.70:

$$\text{tap void} = (\text{true density} - \text{tap density})/\text{true density}.$$

22. The toner according to claim 1, wherein the toner has a tap void of 0.50–0.70.

23. The toner according to claim 1, wherein the toner particles contain 0.5–20 wt. % of a wax per 100 wt. parts of the binder resin.

24. The toner according to claim 6, wherein the external additive particles include inorganic fine powder (B) in addition to the external additive particles (A).

25. The toner according to claim 24, wherein the inorganic fine powder (B) comprises hydrophobic silica fine powder.

26. The toner according to claim 6, wherein the external additive particles include fine powder agglomerate (C) comprising silicone oil or varnish and fine powder in addition to the external additive particles (A).

27. The toner according to claim 26, wherein the fine powder agglomerate (C) contains 20–70 wt. % of the silicone oil or varnish.

28. The toner according to claim 6, wherein the external additive particles include resin particles (D) in addition to the external additive particles (A).

29. The toner according to claim 28, wherein the resin particles (D) comprise a styrene copolymer.

30. The toner according to claim 6, wherein the external additive particles include inorganic fine powder (B), fine powder agglomerate (C) comprising silicone oil or varnish and fine powder and resin particles (D) in addition to the external additive particles (A).

31. The toner according to claim 1, wherein the toner is a negatively chargeable magnetic toner including the toner particles which contain a negative charge control agent and a magnetic material as the colorant.

32. The toner according to claim 1, wherein the toner is a magnetic toner including the toner particles which contain a magnetic material as the colorant.

33. The toner according to claim 32, wherein the toner particles contain 30–200 wt. parts of the magnetic material per 100 wt. parts of the binder resin.

34. An image forming method, comprising the steps of:

charging an image-bearing member for bearing an electrostatic latent image thereon;

forming an electrostatic latent image on the charged image bearing member, and developing the electrostatic latent image on the image-bearing member with a toner to form a toner image;

wherein the toner comprises toner particles comprising a binder resin and a colorant, and external additive particles; and the toner satisfies the particle size distribution conditions (i) and (ii) below, (i) a particle size distribution based on volume-basis and number-basis particle size distribution of particles having sizes in a range of 2.00–40.30 μm as measured by a Coulter counter, including a weight-average particle size D4 of X μm and Y % by number of particles having sizes of 2.00–3.17 μm satisfying the following conditions (1) and (2):

$$-5X+35 \leqq Y \leqq -25X+180 \quad (1)$$

$$3.5 \leqq X \leqq 6.5 \quad (2), \text{ and}$$

(ii) a particle size distribution of particles having circle-equivalent diameters in a range of 0.60 μmμ159.21 μm as measured by a flow particle image analyzer, including A % by number of particles having circle-equivalent diameters of at least 1.00 μm and below 1.03 μm and B % by number of particles having circle-equivalent diameters of at least 2.00 μm and below 2.06 μm satisfying the following condition (3):

$$B-A \leqq 0.30 \quad (3).$$

35. The image forming method according to claim 34, wherein the parameters A and B satisfy the following condition (4):

$$-0.63 \leqq B-A \leqq 0.30 \quad (4).$$

36. The image forming method according to claim 34, wherein the parameters X and Y satisfy the following conditions (5) and (6):

$$-5X+35 \leqq Y \leqq -12.5X+98.75 \quad (1)$$

$$4.0 \leqq X \leqq 6.3 \quad (6).$$

37. The image forming method according to claim 34, wherein the toner contains at least 10% by number of particles having circle-equivalent diameters of at least 1.00 μm and below 2.00 μm.

38. The image forming method according to claim 34, wherein the toner contains 10–37.7% by number of particles having circle-equivalent diameters of at least 1.00 μm and below 2.00 μm.

39. The image forming method according to claim 34, wherein the external additive particles include external additive particles (A) having a number-average circle-equivalent diameter of 0.60–4.00 μm as measured by the flow particle image analyzer.

40. The image forming method according to claim 34, wherein the external additive particles include external additive particles (A) having a number-average circle-equivalent diameter of 1.00–4.00 μm as measured by the flow particle image analyzer.

41. The image forming method according to claim 34, wherein the external additive particles include external additive particles (A) having a number-average circle-equivalent diameter of 1.00–3.00 μm as measured by the flow particle image analyzer.

42. The image forming method according to claim 34, wherein the toner particles contain less than 10% by number of particles having circle-equivalent diameters of at least 1.00 μm and below 2.00 μm according to the flow particle image analyzer measurement; and the external additive particles include external additive particles (A) having a number-average circle-equivalent diameter of 0.60–4.00 μm according to the flow particle image analyzer measurement.

43. The image forming method according to claim 34, wherein the toner particles contain less than 10% by number of particles having circle-equivalent diameters of at least 1.00 μm and below 2.00 μm according to the flow particle image analyzer measurement; and the external additive particles include external additive particles (A) having a number-average circle-equivalent diameter of 1.00–4.00 μm according to the flow particle image analyzer measurement.

44. The image forming method according to claim 34, wherein the toner particles contain less than 10% by number of particles having circle-equivalent diameters of at least 1.00 μm and below 2.00 μm according to the flow particle image analyzer measurement; and the external additive particles include external additive particles (A) having a number-average circle-equivalent diameter of 1.00–3.00 μm according to the flow particle image analyzer measurement.

45. The image forming method according to claim 39, wherein the external additive particles (A) contain a % by number of particles having circle-equivalent diameters of at least 1.00 μm and below 1.03 μm and b % number of particles having circle-equivalent diameters of at least 2.00 μm and below 2.06 μm, satisfying the following condition (7):

$$b-a \leqq 0.3 \quad (7).$$

46. The image forming method according to claim 39, wherein the external additive particles (A) contain a % by number of particles having circle-equivalent diameters of at least 1.00 am and below 1.03 μm and b % number of particles having circle-equivalent diameters of at least 2.00 μm and below 2.06 μm, satisfying the following condition (8):

$$-0.63 \leqq b-a \leqq 0.3 \quad (8).$$

47. The image forming method according to claim 39, wherein the external additive particles (A) contain a % by number of particles having circle-equivalent diameters of at least 1.00 μm and below 1.03 μm and b % number of particles having circle-equivalent diameters of at least 2.00 μm and below 2.06 μm, satisfying the following condition (9):

$$-0.51 \leqq b=a \leqq 0.3 \quad (9).$$

48. The image forming method according to claim 34, wherein the toner particles have been subjected to pre-classification so as to have a reduced content of less than 10% by number of particles having circle-equivalent diameters of at least 1.00 μm and below 2.00 μm according to the flow particle image analyzer measurement prior to being blended with the external additive particles for toner preparation.

49. The image forming method according to claim 34, wherein the external additive particles include external additive particles (A) which have been subjected a wet-classification by sedimentation for particle size distribution adjustment so as to have a particle size distribution according to the flow particle image analyzer measurement, including a % by number of particles having circle-equivalent diameters of at least 1.00 μm and below 1.03 μm and b % number of particles having circle-equivalent diameters of at least 2.00 μm and below 2.06 μm, satisfying the following condition (7):

$$b-a \leqq 0.3 \quad (7).$$

50. The image forming method according to claim 34, wherein the external additive particles include external additive particles (A) which have been subjected a wet-classification by sedimentation for particle size distribution adjustment so as to have a particle size distribution according to the flow particle image analyzer measurement, including a % by number of particles having circle-equivalent diameters of at least 1.00 μm and below 1.03 μm and b % number of particles having circle-equivalent diameters of at least 2.00 μm and below 2.06 μm, satisfying the following condition (8):

$$-0.63 \leqq b-a \leqq 0.3 \quad (8).$$

51. The image forming method according to claim 34, wherein the external additive particles include external additive particles (A) which have been subjected a wet-classification by sedimentation for particle size distribution adjustment so as to have a particle size distribution according to the flow particle image analyzer measurement, including a % by number of particles having circle-equivalent diameters of at least 1.00 μm and below 1.03 μm and b % number of particles having circle-equivalent diameters of at least 2.00 μm and below 2.06 μm, satisfying the following condition (9):

$$-0.51 \leqq b-a \leqq 0.3 \quad (9).$$

52. The image forming method according to claim 39, wherein the external additive particles (A) comprise at least one species of particles selected from the group consisting of metal oxide particles, complex metal oxide particles, metal salt particles, clay mineral particles, phosphate compound particles, silicon compound particles, carbon compound particles, resin particles, complex particles of organic compound and inorganic compound, aliphatic acid derivative particles, and lubricant particles.

53. The image forming method according to claim 39, wherein the external additive particles (A) comprise particles of at least one species of compound selected from the group consisting of zinc oxide, aluminum oxide, titanium oxide, zirconium oxide, manganese oxide, strontium titanate, magnesium titanate, and barium titanate.

54. The image forming method according to claim 34, wherein the toner has a tap void as defined by the following formula of 0.45–0.70:

$$\text{tap void} = (\text{true density} - \text{tap density})/\text{true density}.$$

55. The image forming method according to claim 54, wherein the toner has a tap void of 0.50–0.70.

56. The image forming method according to claim 34, wherein the toner particles contain 0.5–20 wt. % of a wax per 100 wt. parts of the binder resin.

57. The image forming method according to claim 39, wherein the external additive particles include inorganic fine powder (B) in addition to the external additive particles (A).

58. The image forming method according to claim 57, wherein the inorganic fine powder (B) comprises hydrophobic silica fine powder.

59. The image forming method according to claim 39, wherein the external additive particles include fine powder agglomerate (C) comprising silicone oil or varnish and fine powder in addition to the external additive particles (A).

60. The image forming method according to claim 59, wherein the fine powder agglomerate (C) contains 20–70 wt. % of the silicone oil or varnish.

61. The image forming method according to claim 39, wherein the external additive particles include resin particles (D) in addition to the external additive particles (A).

62. The image forming method according to claim 61, wherein the resin particles (D) comprise a styrene copolymer.

63. The image forming method according to claim 39, wherein the external additive particles include inorganic fine powder (B), fine powder agglomerate (C) comprising silicone oil or varnish and fine powder and resin particles (D) in addition to the external additive particles (A).

64. The image forming method according to claim 34, wherein the toner is a negatively chargeable magnetic toner including the toner particles which contain a negative charge control agent and a magnetic material as the colorant.

65. The image forming method according to claim 34, wherein the toner is a magnetic toner including the toner particles which contain a magnetic material as the colorant.

66. The image forming method according to claim 65, wherein the toner particles contain 30–200 wt. parts of the magnetic material per 100 wt. parts of the binder resin.

67. The image forming method according to claim 1, wherein, in the developing step, the toner is formed in a thin layer on a toner carrying member, so that the toner layer has a smaller thickness than a gap between the toner-carrying member and the image-bearing member at a developing position, and the toner is non-contactively transferred onto the image-bearing member to develop the electrostatic latent image formed thereon.

68. The image forming method according to claim 1, wherein, in the developing step, the toner-carrying member is supplied with a bias voltage for developing the electrostatic latent image formed on the image-bearing member.

69. The image forming method according to claim 34, wherein the image-bearing member comprises an electrophotographic photosensitive member.

70. A process cartridge detachably mountable to a main body of an image forming apparatus, comprising:

an image-bearing member for bearing an electrostatic latent image, and a developing means containing a toner for developing an electrostatic latent image on the image-bearing member to form a toner image;

wherein the toner comprises toner particles comprising a binder resin and a colorant, and external additive particles;

wherein the toner satisfies the particle size distribution conditions (i) and (ii) below, (i) a particle size distribution based on volume-basis and number-basis particle size distribution of particles having sizes in a range of 2.00–40.30 μm as measured by a Coulter counter, including a weight-average particle size D4 of X μm and Y % by number of particles having sizes of 2.00–3.17 μm satisfying the following conditions (1) and (2):

$$-5X+35 \leqq Y \leqq -25X+180 \quad (1)$$

$$-3.5 \leqq X \leqq 6.5 \quad (2), \text{ and}$$

(ii) a particle size distribution of particles having circle-equivalent diameters in a range of 0.60 μm–159.21 μm as measured by a flow particle image analyzer, including A % by number of particles having circle-equivalent diameters of at least 1.00 μm and below 1.03 μm and B % by number of particles having circle-equivalent diameters of at least 2.00 μm and below 2.06 μm satisfying the following condition (3):

$$B-A \leqq 0.30 \quad (3).$$

71. The process cartridge according to claim 70, wherein the parameters A and B satisfy the following condition (4):

$$-0.63 \leqq B-A \leqq 0.30 \quad (4).$$

72. The process cartridge according to claim 70, wherein the parameters X and Y satisfy the following conditions (5) and (6):

$$-5X+35 \leqq Y \leqq -12.5X+98.75 \quad (1)$$

$$4.0 \leqq X \leqq 6.3 \quad (6).$$

73. The process cartridge according to claim 70, wherein the toner contains at least 10% by number of particles having circle-equivalent diameters of at least 1.00 μm and below 2.00 μm.

74. The process cartridge according to claim 70, wherein the toner contains 10–37.7% by number of particles having circle-equivalent diameters of at least 1.00 μm and below 2.00 μm.

75. The process cartridge according to claim 70, wherein the external additive particles include external additive particles (A) having a number-average circle-equivalent diameter of 0.60–4.00 μm as measured by the flow particle image analyzer.

76. The process cartridge according to claim 70, wherein the external additive particles include external additive particles (A) having a number-average circle-equivalent diameter of 1.00–4.00 μm as measured by the flow particle image analyzer.

77. The process cartridge according to claim 70, wherein the external additive particles include external additive particles (A) having a number-average circle-equivalent diameter of 1.00–3.00 μm as measured by the flow particle image analyzer.

78. The process cartridge according to claim 70, wherein the toner particles contain less than 10% by number of particles having circle-equivalent diameters of at least 1.00 μm and below 2.00 μm according to the flow particle image analyzer measurement; and the external additive particles include external additive particles (A) having a number-average circle-equivalent diameter of 0.60–4.00 μm according to the flow particle image analyzer measurement.

79. The process cartridge according to claim 70, wherein the toner particles contain less than 10% by number of particles having circle-equivalent diameters of at least 1.00 μm and below 2.00 μm according to the flow particle image analyzer measurement; and the external additive particles include external additive particles (A) having a number-average circle-equivalent diameter of 1.00–4.00 μm according to the flow particle image analyzer measurement.

80. The process cartridge according to claim 70, wherein the toner particles contain less than 10% by number of particles having circle-equivalent diameters of at least 1.00 μm and below 2.00 μm according to the flow particle image analyzer measurement; and the external additive particles include external additive particles (A) having a number-average circle-equivalent diameter of 1.00–3.00 μm according to the flow particle image analyzer measurement.

81. The process cartridge according to claim 75, wherein the external additive particles (A) contain a % by number of particles having circle-equivalent diameters of at least 1.00 μm and below 1.03 μm and b % number of particles having circle-equivalent diameters of at least 2.00 μm and below 2.06 μm, satisfying the following condition (7):

$$b-a \leqq 0.3 \quad (7).$$

82. The process cartridge according to claim 75, wherein the external additive particles (A) contain a % by number of particles having circle-equivalent diameters of at least 1.00 μm and below 1.03 μm and b % number of particles having circle-equivalent diameters of at least 2.00 μm and below 2.06 μm, satisfying the following condition (8):

$$-0.63 \leqq b-a \leqq 0.3 \quad (8).$$

83. The process cartridge according to claim 75, wherein the external additive particles (A) contain a % by number of particles having circle-equivalent diameters of at least 1.00 μm and below 1.03 μm and b % number of particles having circle-equivalent diameters of at least 2.00 μm and below 2.06 μm, satisfying the following condition (9):

$$-0.51 \leqq b-a \leqq 0.3 \quad (9).$$

84. The process cartridge according to claim 70, wherein the toner particles have been subjected to pre-classification so as to have a reduced content of less than 10% by number of particles having circle-equivalent diameters of at least 1.00 μm and below 2.00 μm according to the flow particle image analyzer measurement prior to being blended with the external additive particles for toner preparation.

85. The process cartridge according to claim 70, wherein the external additive particles include external additive particles (A) which have been subjected a wet-classification by sedimentation for particle size distribution adjustment so as to have a particle size distribution according to the flow particle image analyzer measurement, including a % by number of particles having circle-equivalent diameters of at least 1.00 μm and below 1.03 μm and b % number of particles having circle-equivalent diameters of at least 2.00 μm and below 2.06 μm, satisfying the following condition (7):

$$b-a \leqq 0.3 \quad (7).$$

86. The process cartridge according to claim 70, wherein the external additive particles include external additive particles (A) which have been subjected a wet-classification by sedimentation for particle size distribution adjustment so as to have a particle size distribution according to the flow particle image analyzer measurement, including a % by number of particles having circle-equivalent diameters of at least 1.00 μm and below 1.03 μm and b % number of particles having circle-equivalent diameters of at least 2.00 μm and below 2.06 μm, satisfying the following condition (8):

$$-0.63 \leqq b-a \leqq 0.3 \quad (8).$$

87. The process cartridge according to claim 70, wherein the external additive particles include external additive particles (A) which have been subjected a wet-classification by sedimentation for particle size distribution adjustment so as to have a particle size distribution according to the flow particle image analyzer measurement, including a % by number of particles having circle-equivalent diameters of at least 1.00 μm and below 1.03 μm and b % number of particles having circle-equivalent diameters of at least 2.00 μm and below 2.06 μm, satisfying the following condition (9):

$$-0.51 \leqq b-a \leqq 0.3 \quad (9).$$

88. The process cartridge according to claim 75, wherein the external additive particles (A) comprise at least one species of particles selected from the group consisting of metal oxide particles, complex metal oxide particles, metal salt particles, clay mineral particles, phosphate compound particles, silicon compound particles, carbon compound particles, resin particles, complex particles of organic compound and inorganic compound, aliphatic acid derivative particles, and lubricant particles.

89. The process cartridge according to claim 75, wherein the external additive particles (A) comprise particles of at least one species of compound selected from the group consisting of zinc oxide, aluminum oxide, titanium oxide, zirconium oxide, manganese oxide, strontium titanate, magnesium titanate, and barium titanate.

90. The process cartridge according to claim 70, wherein the toner has a tap void as defined by the following formula of 0.45–0.70:

tap void=(true density−tap density)/true density.

91. The process cartridge according to claim 90, wherein the toner has a tap void of 0.50–0.70.

92. The process cartridge according to claim 70, wherein the toner particles contain 0.5–20 wt. % of a wax per 100 wt. parts of the binder resin.

93. The process cartridge according to claim 75, wherein the external additive particles include inorganic fine powder (B) in addition to the external additive particles (A).

94. The process cartridge according to claim 93, wherein the inorganic fine powder (B) comprises hydrophobic silica fine powder.

95. The process cartridge according to claim 75, wherein the external additive particles include fine powder agglomerate (C) comprising silicone oil or varnish and fine powder in addition to the external additive particles (A).

96. The process cartridge according to claim 95, wherein the fine powder agglomerate (C) contains 20–70 wt. % of the silicone oil or varnish.

97. The process cartridge according to claim 75, wherein the external additive particles include resin particles (D) in addition to the external additive particles (A).

98. The process cartridge according to claim 97, wherein the resin particles (D) comprise a styrene copolymer.

99. The process cartridge according to claim 75, wherein the external additive particles include inorganic fine powder (B), fine powder agglomerate (C) comprising silicone oil or varnish and fine powder and resin particles (D) in addition to the external additive particles (A).

100. The process cartridge according to claim 70, wherein the toner is a negatively chargeable magnetic toner including the toner particles which contain a negative charge control agent and a magnetic material as the colorant.

101. The process cartridge according to claim 70, wherein the toner is a magnetic toner including the toner particles which contain a magnetic material as the colorant.

102. The process cartridge according to claim 101, wherein the toner particles contain 30–200 wt. parts of the magnetic material per 100 wt. parts of the binder resin.

103. The process cartridge according to claim 70, wherein the developing means includes a toner-carrying member which is disposed with a gap from the image-bearing member at a developing position and is operated to carry a toner layer having a thickness smaller than the gap so that the toner is non-contactively transferred onto the image-bearing member to develop the electrostatic latent image formed thereon.

104. The process cartridge according to claim 103, wherein, in the developing step, the toner-carrying member is supplied with a bias voltage for developing the electrostatic latent image formed on the image-bearing member.

105. The process cartridge according to claim 70, wherein the image-bearing member comprises an electrophotographic photosensitive member.

106. The process cartridge according to claim 70, further comprising a charging member for primarily charging the image-bearing member.

107. The process cartridge according to claim 7, further comprising a cleaning member for cleaning a surface of the image-bearing member.

108. The process cartridge according to claim 70, further comprising a charging member for primarily charging the image-bearing member, and a cleaning member for cleaning a surface of the image-bearing member.

* * * * *

UNITED STATES PATENT AND TRADEMARK OFFICE

CERTIFICATE OF CORRECTION

PATENT NO. : 6,060,202
DATED : May 9, 2000
INVENTOR(S) : Yoshihiro Ogawa et al.

It is certified that error appears in the above-identified patent and that said Letters Patent is hereby corrected as shown below:

On the Title Page:
Item [54] In the title "IMAGES IMAGE" should read --IMAGES, IMAGE--;
Item [30] Foreign Application Priority Data "July 11, 1997 [JP] Japan 9-305145" should read
--Nov. 7, 1991 [JP] Japan 9-305145--; and Item [56] References Cited under FOREIGN PATENT DOCUMENTS "41-20153 11/1996 Japan" should read --41-20153 11/1966 Japan--; and
"6-3854 1/1995 Japan" should read --6-3854 1/1996 Japan--.

Column 1:
Line 2, "IMAGES IMAGE" should read --IMAGES, IMAGE--.

Column 2:
Line 16, "a" should be deleted.

Column 5:
Line 46, "1.0014 3.00 μm," should read --1.00-3.00 μm,--.

Column 14:
Line 37, "$CH_3(CH_2)^nCH_2COOH$ (n=20-300)" should read
--$CH_3(CH_2)_nCH_2COOH$ (n=20-300)--; and
Line 38, "(n=20-200, m=0-100)" should read --(n=20-200, m=0-100)--.

Column 15:
Line 10, "30-20wt. Parts," should read --30-200 wt. parts,--.

Column 16:
Line 62, "—CO—O—." should read -- —CO • O—.--.

Column 18:
Line 26, "$A^+$" should read --$A_1^+$"--.

UNITED STATES PATENT AND TRADEMARK OFFICE

CERTIFICATE OF CORRECTION

PATENT NO. : 6,060,202
DATED : May 9, 2000
INVENTOR(S) : Yoshihiro Ogawa et al.

It is certified that error appears in the above-identified patent and that said Letters Patent is hereby corrected as shown below:

Column 23:
Line 40, "hydrophillic" should read --hydrophilic--;
Line 56, "oxides for example" should read --oxides, for example,--.
Line 58, "struder." should read extruder.--.

Column 25:

Line 36, " 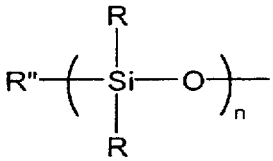 " should read

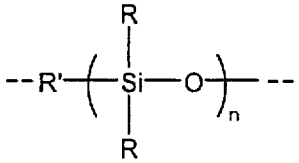

Column 27:
Line 66, "silicon" should read --silicone--.

Column 29:
Line 23, "$10^5$-2x$10^5$" should read --$10^5$-2x$10^5$--; and
Line 43, "an" should read --a--.

Column 30:
Line 4, "charger" should read --charger 11--.

Column 31:
Line 15, "Alternative," should read --Alternatively,--.

Column 32:
Line 58, "struder." should read --extruder.--.

UNITED STATES PATENT AND TRADEMARK OFFICE

CERTIFICATE OF CORRECTION

PATENT NO. : 6,060,202
DATED : May 9, 2000
INVENTOR(S) : Yoshihiro Ogawa et al.

It is certified that error appears in the above-identified patent and that said Letters Patent is hereby corrected as shown below:

Column 33:
Line 36, "$_{\mu m}$=4-4 N.%" should read --$_{\mu m}$=4.4 N.%--; and
Line 63, "toner. Example 7 In" should read --toner. ¶Example 7 ¶In--.

Column 34:
Line 1, "toner. Example 8 In" should read --toner. ¶Example 8 ¶In--;
Line 26, "Dv=5.03 Pm," should read --Dv=5.03 μm,--; and
Line 66, "$C_{2.00\text{-}3.17\mu m}$15.4N.%." should read --$C_{2.00\text{-}3.17\mu m}$=15.4N.%.--.

Column 35:
Line 21, "reprenishing" should read --replenishing--.

Column 36:
Line 6, "(75 g/m2)" should read --(75 g/m$^2$)--.

Column 37:
Line 54, "extend" should read --external--.

Column 38:
Line 25, "extend" should read --external--.

Column 39:
Line 4, "extend" should read --external--; and
Line 55, "extend" should read --external--.

Column 40:
Line 4, "extend" should read --external--.

Column 41:
Line 4, "extend" should read --external--.

UNITED STATES PATENT AND TRADEMARK OFFICE

CERTIFICATE OF CORRECTION

PATENT NO. : 6,060,202
DATED : May 9, 2000
INVENTOR(S) : Yoshihiro Ogawa et al.

It is certified that error appears in the above-identified patent and that said Letters Patent is hereby corrected as shown below:

Column 43:
Line 51, "-0.63b-a≤ 0.3" should read -- -0.63≤ b-a ≤0.3--.

Column 44:
Line 59, "and developing" should read --and ¶developing--.

Column 45:
Line 13, "0.60 μmμ159.21 μm" should read --0.60 μmμ−159.21 μm--.

Column 46:
Line 34, "1.00 am" should read --1.00 μm--; and
Line 47, "-0.51≤ b=a≤ 0.3" should read -- -0.51≤ b-a ≤0.3--.

Column 48:
Line 57, "-3.5≤ X≤ 6.5" should read --3.5≤ X≤ 6.5--.

Signed and Sealed this

Nineteenth Day of June, 2001

*Attest:*

Nicholas P. Godici

*Attesting Officer*

NICHOLAS P. GODICI
*Acting Director of the United States Patent and Trademark Office*